US008396395B2

(12) United States Patent
Aoyagi

(10) Patent No.: US 8,396,395 B2
(45) Date of Patent: Mar. 12, 2013

(54) IMAGE FORMING APPARATUS WITH IMAGE BEARING MEMBER SPEED AND PHASE CONTROL

(75) Inventor: Shigeo Aoyagi, Moriya (JP)

(73) Assignee: Canon Kabushiki Kaisha (JP)

( * ) Notice: Subject to any disclaimer, the term of this patent is extended or adjusted under 35 U.S.C. 154(b) by 327 days.

(21) Appl. No.: 12/183,867

(22) Filed: Jul. 31, 2008

(65) Prior Publication Data

US 2009/0052922 A1 Feb. 26, 2009

(30) Foreign Application Priority Data

Aug. 2, 2007 (JP) ..... 2007-201950

(51) Int. Cl.
*G03G 15/01* (2006.01)
*G03G 15/02* (2006.01)
*G03G 15/20* (2006.01)

(52) U.S. Cl. ..... 399/167; 399/299; 399/301; 399/302; 399/308

(58) Field of Classification Search ..... 399/301
See application file for complete search history.

(56) References Cited

U.S. PATENT DOCUMENTS

| | | | | |
|---|---|---|---|---|
| 6,408,157 | B1 * | 6/2002 | Tanaka et al. | 399/301 |
| 6,771,919 | B2 * | 8/2004 | Koide | 399/167 |
| 7,215,907 | B2 * | 5/2007 | Fukuchi et al. | 399/167 |
| 2005/0271418 | A1 * | 12/2005 | Kojima | 399/167 |
| 2005/0271429 | A1 * | 12/2005 | Tachibana et al. | 399/301 |
| 2006/0039722 | A1 * | 2/2006 | Ehara | 399/301 |
| 2006/0140648 | A1 * | 6/2006 | Takegawa | 399/12 |
| 2006/0210325 | A1 * | 9/2006 | Funamoto | 399/301 |
| 2006/0228129 | A1 * | 10/2006 | Yamada | 399/101 |
| 2006/0275056 | A1 * | 12/2006 | Matsuda et al. | 399/301 |
| 2007/0041753 | A1 * | 2/2007 | Kiryu | 399/301 |
| 2007/0048017 | A1 * | 3/2007 | Kiryu | 399/167 |
| 2007/0127948 | A1 * | 6/2007 | Akiyama | 399/167 |
| 2007/0140736 | A1 * | 6/2007 | Ehara et al. | 399/167 |
| 2007/0172257 | A1 * | 7/2007 | Matsuda et al. | 399/167 |
| 2007/0217830 | A1 * | 9/2007 | Matsuda et al. | 399/301 |
| 2008/0271556 | A1 * | 11/2008 | Imamura et al. | 74/412 R |
| 2009/0022504 | A1 * | 1/2009 | Kuwabara et al. | 399/12 |

FOREIGN PATENT DOCUMENTS

JP 2006-201255 A 8/2006

* cited by examiner

*Primary Examiner* — Walter L Lindsay, Jr.
*Assistant Examiner* — David Bolduc
(74) *Attorney, Agent, or Firm* — Rossi, Kimms & McDowell LLP

(57) ABSTRACT

An image forming apparatus which is capable of suppressing damages to a plurality of photosensitive drums and an intermediate transfer belt, and reducing loads on drive sources of the photosensitive drums and the intermediate transfer belt, during control for making the respective rotational phases of the photosensitive drums in phase. The intermediate transfer belt is driven for rotation in a state in contact with the photosensitive drums. Sensors detect the rotational speeds of the photosensitive drums and the intermediate transfer belt. Control sections control the rotational speeds and rotational phases of the photosensitive drums based on the results of detections by the sensors. When each control section performs rotational phase control, a limiter thereof limits the speed difference between the associated photosensitive drum and the intermediate transfer belt when the speed difference exceeds a predetermined range.

12 Claims, 21 Drawing Sheets

IMAGE FORMING APPARATUS WITH IMAGE BEARING MEMBER SPEED AND PHASE CONTROL

BACKGROUND OF THE INVENTION

1. Field of the Invention

The present invention relates to an image forming apparatus that includes a plurality of a plurality of image bearing members brought into contact with an intermediate transfer unit, such as an intermediate transfer belt.

2. Description of the Related Art

Conventionally, in an image forming apparatus of the above-mentioned kind, a plurality of image forming stations for forming toner images of different colors are arranged in the direction of motion of an intermediate transfer unit, such as an intermediate transfer belt. In the image forming stations, there are arranged image bearing members, such as photosensitive drums, which are driven at predetermined rotational speeds, respectively. Around each image bearing member, there are arranged an electrostatic charger, an image writing section, and a developing device.

While all the image bearing members are being driven for rotation, toner images formed on the respective image bearing members are superposed one upon another on a transfer medium. Then, after the toner images on the transfer medium are transferred onto a conveyed sheet, the toner image are subjected to a fixing process, whereby a color image is formed on the sheet.

In the above-described image forming apparatus, toner images formed on the image bearing members are superposed one upon another on the transfer medium to thereby form a color image, so that unless the toner images are accurately superposed one upon another without color misregistration caused by displacement of the toner images, it is impossible to obtain high-quality color images.

However, it is known that if the center of rotation of a drive source of an image bearing member, such as a photosensitive drum, or the center of rotation of a drive source of the intermediate transfer unit, such as the intermediate transfer belt, is eccentric, the position of a toner image is displaced to cause periodic color misregistration.

To overcome the problem, there has been proposed an image forming apparatus configured to perform control so as to make the respective rotational phases of photosensitive drums in phase (adjust the rotational phase relationship), to thereby prevent toner images from being displaced to suppress periodic color misregistration (see Japanese Patent Laid-Open Publication No. 2006-201255).

In the above-described Japanese Patent Laid-Open Publication No. 2006-201255, however, the control for making the respective rotational phases of the photosensitive drums in phase is performed in a state in which the photosensitive drums and the intermediate transfer belt are in contact with each other. Therefore, insofar as the respective rotational phases of the photosensitive drums are not in phase at the start of the rotational phase control, a speed difference is inevitably caused between the photosensitive drums and the intermediate transfer belt. As a consequence, there occurs slips between the photosensitive drums and the intermediate transfer belt, which damages the photosensitive drums and the intermediate transfer belt.

Further, when a slip occur between each photosensitive drum and the intermediate transfer belt, a resisting force corresponding to the amount of slip acts on the photosensitive drum, and a resisting force corresponding to all the amounts of slips of the photosensitive drums acts on the intermediate transfer belt. This causes large loads to act on the drive sources of the photosensitive drums and the intermediate transfer belt.

SUMMARY OF THE INVENTION

The present invention provides an image forming apparatus which is capable of suppressing damages to a plurality of image bearing members and an intermediate transfer unit, and reducing loads on drive sources of the image bearing members and the intermediate transfer unit, when control is performed for making the rotational phases of the image bearing members in phase.

In a first aspect of the present invention, there is provided an image forming apparatus comprising a plurality of image bearing members configured to be driven for rotation, an intermediate transfer unit configured to be driven for rotation in a state in contact with the plurality of image bearing members, a first detecting unit configured to detect a rotational speed of each image bearing member, a second detecting unit configured to detect a rotational speed of the intermediate transfer unit, a control unit configured to control the rotational speeds and rotational phases of the plurality of image bearing members based on results of detections by the first detecting unit and the second detecting unit, and a limiting unit configured to limit a speed difference between each image bearing member and the intermediate transfer unit when the speed difference exceeds a predetermined range during control executed by the control unit for making the rotational phases of the plurality of image bearing members in phase.

In a second aspect of the present invention, there is provided an image forming apparatus comprising a plurality of image bearing members configured to be driven for rotation, an intermediate transfer unit configured to be driven for rotation in a state in contact with the plurality of image bearing members, a first detecting unit configured to detect a rotational speed of each image bearing member, a second detecting unit configured to detect a rotational speed of the intermediate transfer unit, a control unit configured to control the rotational speeds and rotational phases of the plurality of image bearing members based on results of detections by the first detecting unit and the second detecting unit, and a switching unit configured to be capable of switching between rotational speed control executed by the control unit for controlling the rotational speeds of the plurality of image bearing members and rotational phase control executed by the control unit for making the rotational phases of the plurality of image bearing members in phase, the switching unit switching between the rotational speed control and the rotational phase control for each of at least one of the plurality of image bearing members.

According to the present invention, it is possible to suppress damages to the image bearing members and the intermediate transfer unit, and reduce loads on the drive sources of the image bearing members and the intermediate transfer unit, when control is performed for making the rotational phases of the image bearing members in phase.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof.

Figure 1:
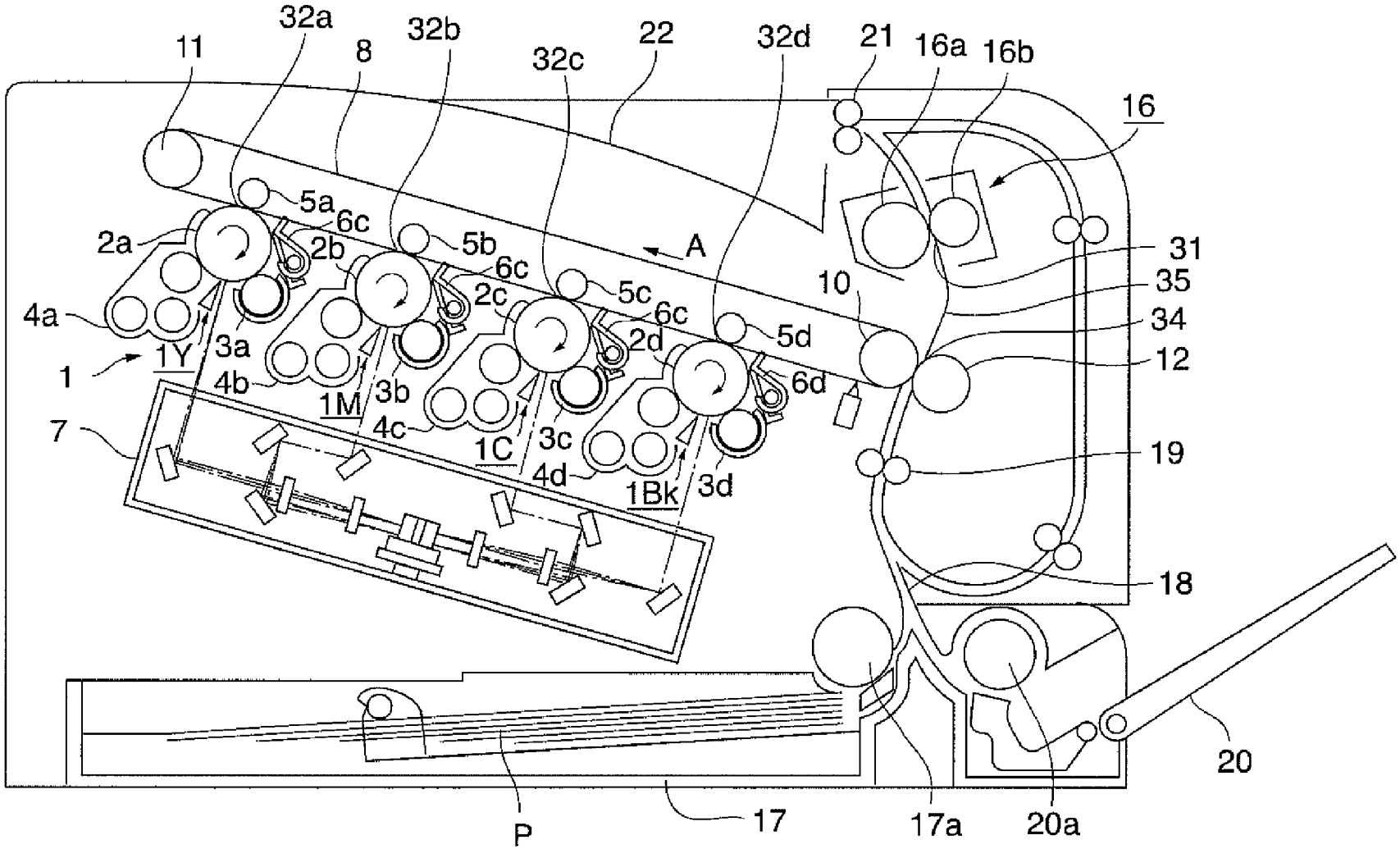
FIG. 1 is a schematic cross-sectional view of an image forming apparatus according to a first embodiment of the present invention.

FIG. 1 is a schematic cross-sectional view of an image forming apparatus according to a first embodiment of the present invention.

The image forming apparatus according to the present embodiment is comprised of an image forming section 1Y that forms a yellow image, an image forming section 1M that forms a magenta image, an image forming section 1C that forms a cyan image, and an image forming section 1Bk that forms a black image.

The image forming sections 1Y, 1M, 1C, and 1Bk are arranged in a row at predetermined space intervals. Arranged below the image forming sections are a sheet feed cassette 17 and a manual feed tray 20.

In the image forming sections 1Y, 1M, 1C, and 1Bk, there are disposed drum-type electrophotographic photosensitive members (hereinafter referred to as "the photosensitive drums") 2*a*, 2*b*, 2*c*, and 2*d* as image bearing members, respectively. The photosensitive drums 2*a*, 2*b*, 2*c*, and 2*d* are negatively charged OPC photosensitive members, and each have a photoconductive layer formed on an aluminum drum substrate thereof. The photosensitive drums 2*a*, 2*b*, 2*c*, and 2*d* are each driven by a driving device (not shown) for rotation in a direction (clockwise direction) indicated by an arrow at a predetermined processing speed.

Around the photosensitive drums 2*a*, 2*b*, 2*c*, and 2*d*, there are arranged primary electrostatic chargers 3*a*, 3*b*, 3*c*, and 3*d*, developing devices 4*a*, 4*b*, 4*c*, and 4*d*, transfer rollers 5*a*, 5*b*, 5*c*, and 5*d* as transfer units, and drum cleaners 6*a*, 6*b*, 6*c*, and 6*d*, respectively.

Further, a laser exposure device 7 is disposed below the primary electrostatic chargers 3*a*, 3*b*, 3*c* and 3*d*, and the developing devices 4*a*, 4*b*, 4*c*, and 4*d*. Each of the primary electrostatic chargers 3*a*, 3*b*, 3*c*, and 3*d* uniformly charges the surface of an associated one of the photosensitive drums 2*a*, 2*b*, 2*c*, and 2*d* to a predetermined negative potential by a charge bias applied from a charge bias power source (not shown).

The laser exposure device 7 is comprised of a laser unit 117 (see FIG. 2) for emitting light according to a time-series electric digital pixel signal of given image information, polygon mirrors, lenses, and reflective mirrors, and irradiates the respective surfaces of the photosensitive drums 2*a*, 2*b*, 2*c*, and 2*d* with laser light. As a consequence, electrostatic latent images for the respective colors are formed according to the image information on the respective surfaces of the photosensitive drums 2*a*, 2*b*, 2*c*, and 2*d* charged by the respective associated primary electrostatic chargers 3*a*, 3*b*, 3*c*, and 3*d*.

Each of the developing devices 4*a*, 4*b*, 4*c*, and 4*d* contains an associated one of a yellow toner, a cyan toner, a magenta toner, and a black toner, and develops (visualizes) an electrostatic latent image formed on the associated one of the photosensitive drums 2*a*, 2*b*, 2*c*, and 2*d* as a toner image by attaching the associated color to the electrostatic latent image.

Each of the transfer rollers 5*a*, 5*b*, 5*c*, and 5*d* is disposed in an associated one of primary transfer sections 32*a*, 32*b*, 32*c*, and 32*d* such that it can be brought into contact with an associated one of the photosensitive drums 2*a*, 2*b*, 2*c*, and 2*d* via an intermediate transfer belt (intermediate transfer unit) 8.

The toner images of the respective colors of the photosensitive drums 2*a*, 2*b*, 2*c*, and 2*d* are sequentially transferred by the respective associated transfer rollers 5*a*, 5*b*, 5*c*, and 5*d* onto the intermediate transfer belt 8 in superimposed relation.

Each of the drum cleaners 6*a*, 6*b*, 6*c*, and 6*d* is formed e.g. by a cleaning blade, and uses the cleaning blade to scrape off toner remaining on the surface of an associated one of the photosensitive drums 2*a*, 2*b*, 2*c*, and 2*d* during primary transfer, to thereby clean the surface of the associated drum.

The intermediate transfer belt 8 is disposed e.g. toward the respective upper surfaces of the photosensitive drums 2*a*, 2*b*, 2*c*, and 2*d* in a manner stretched between a secondary-transfer opposed roller 10 and a tension roller 11. The secondary-transfer opposed roller 10 is disposed in a secondary transfer section 34 such that it can be brought into contact with a secondary-transfer roller 12 via the intermediate transfer belt 8.

The intermediate transfer belt 8 is formed of a dielectric resin, such as a polycarbonate resin film, a polyethylene terephthalate resin film, or a polyvinylidene fluoride resin film. The toner images transferred from the photosensitive drums 2*a*, 2*b*, 2*c*, and 2*d* onto the intermediate transfer belt 8 is transferred onto a sheet P fed or conveyed from a sheet feed cassette 17 or a manual feed tray 20 via a pickup roller 17*a* or 20*a*, at the secondary transfer section 34. The sheet P having the toner images transferred thereon at the secondary transfer section 34 is conveyed to a fixing unit 16.

When the sheet P fed via the pickup roller 17*a* or 20*a* is conveyed to a registration roller pair 19 via a feed guide 18, the sheet P is temporarily stopped, and then is sent to the secondary transfer section 34 in timing synchronous with image forming operations of the image forming sections 1Y, 1M, 1C, and 1Bk.

The fixing unit 16 includes a roller pair comprised of a fixing roller 16*a* incorporating a heat source, such as a ceramic heater board, and a pressing roller 16*b*. A guide 35 is disposed upstream of the fixing unit 16 in a sheet conveying direction, for guiding the sheet P to a nip 31 of the roller pair while a discharge roller pair 21 is disposed downstream of the fixing unit 16 in the sheet conveying direction for discharging the sheet p having passed through the fixing unit 16 to a discharge tray.

Figure 2:
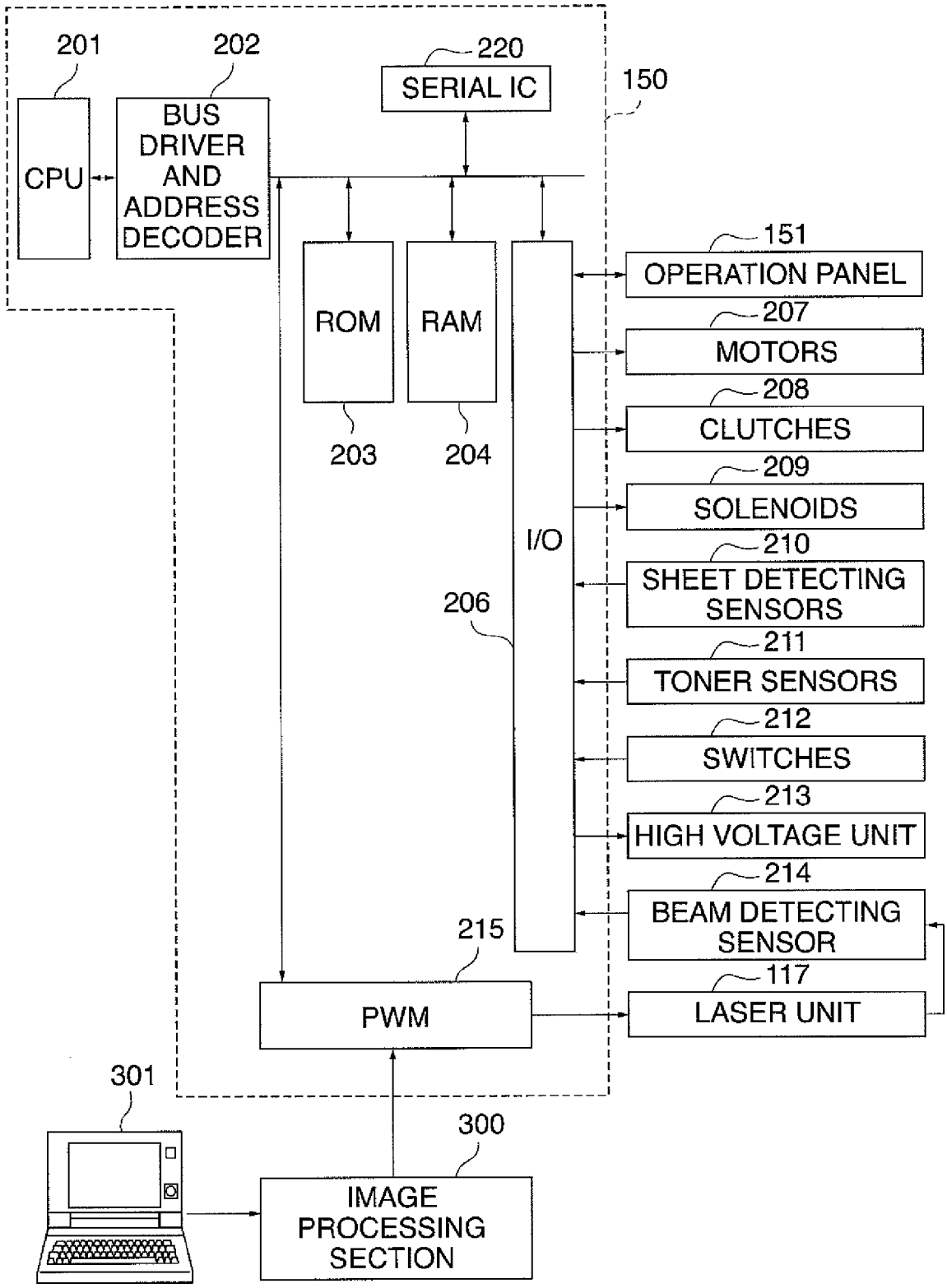
FIG. 2 is a block diagram of a control system of the image forming apparatus.

Next, a control system of the image forming apparatus according to the first embodiment of the present invention will be described with reference to FIG. 2.

The control system of the image forming apparatus according to the present embodiment is comprised of a controller section 150 and an image processing section 300.

The controller section 150 includes a CPU 201 for controlling the overall operation of the apparatus. The CPU 201 sequentially reads out control programs stored in a ROM 203, and executes processes based on the control programs. The CPU 201 has an address bus and a data bus connected to the ROM 203, a RAM 204, a PWM 215, a serial IC 220, and an I/O interface 206, via a bus driver and address decoder circuit 202. The RAM 204 is a main storage device which is used as an input data storage area, a working storage area, and so forth.

The I/O interface 206 is connected to an operation panel 151 via which an operator performs key input and on which states of the apparatus and the like are displayed by LCD (liquid crystal display) and LED, motors 207, clutches 208, and solenoids 209 for driving a sheet feed system, a conveyance system, and an optical system, and a high voltage unit 213. The high voltage unit 213 outputs high voltages to the primary electrostatic chargers 3*a*, 3*b*, 3*c*, and 3*d*, and the developing devices 4*a*, 4*b*, 4*c*, and 4*d* according to instructions from the CPU 201.

Further, the I/O interface 206 is connected to sheet detecting sensors 210 that detect sheets being conveyed. Toner sensors 211 detect the amounts of toner in the developing devices 4*a*, 4*b*, 4*c*, and 4*d*, and delivers signals indicative of the detected amounts of toner to the I/O interface 206. Furthermore, switches 212 detect home positions of respective loads, opened and closed states of doors, and so forth, and deliver signals indicative of the detected home positions, and the opened and closed states of the doors, to the I/O interface 206.

The image processing section 300 delivers control signals to the laser unit 117 via the PWM 215 according to image data generated by subjecting image signals delivered e.g. from a PC (personal computer) 301 to predetermined image processing.

Laser beams emitted from the laser unit 117 are irradiated onto the surfaces of the photosensitive drums 2*a*, 2*b*, 2*c*, and 2*d* for exposure. A beam detecting sensor 214 detects a light-emitting state of the laser unit 117 in a non-image area, and delivers a signal indicative of the detected light-emitting state of the laser unit 117 to the I/O interface 206.

Next, a brief description will be given of a mechanism which is capable of making the respective rotational phases of the photosensitive drums 2*a*, 2*b*, 2*c*, and 2*d* in phase to thereby reduce color misregistration caused by eccentricity of the center of the rotation axis of each of the drums.

Figure 3:
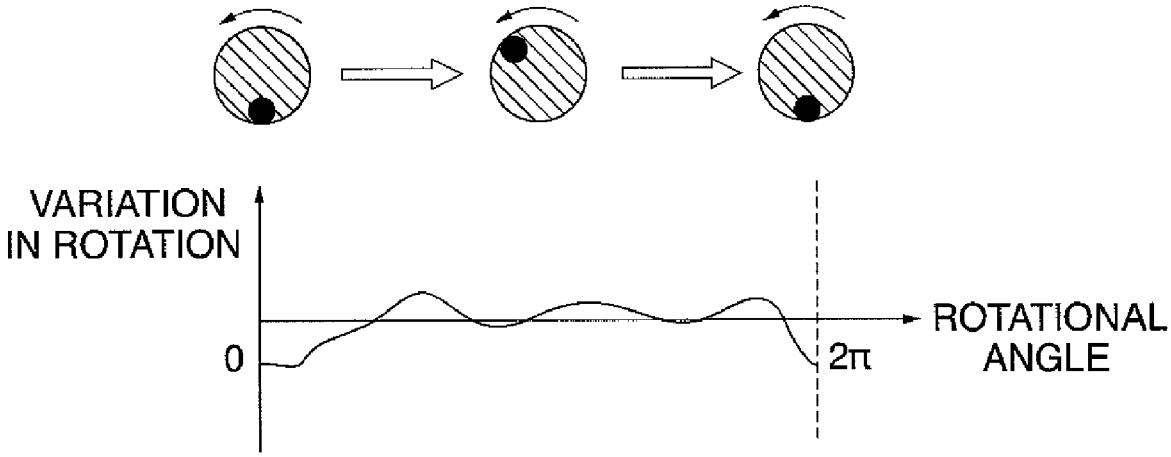
FIG. 3 is a diagram useful in explaining variation in rotation of each of photosensitive drums, which is caused by eccentricity of the center of a rotation axis of the photosensitive drum during one rotation thereof.

FIG. 3 is a diagram showing variation in rotation of each of the photosensitive drums 2*a*, 2*b*, 2*c*, and 2*d*, which is caused by eccentricity of the center of the rotation axis of the drum during one rotation thereof. In a state in which the variation in the rotation of the photosensitive drum is positive (the rotational angular speed of the drum is higher than a predetermined value), a transfer speed at which a toner image is transferred from the drum onto the intermediate transfer belt 8 is increased to produce a finer transferred image (an interval in a sub-scanning direction is reduced=a pitch interval is reduced), whereas in a state in which the variation in the rotation of the photosensitive drum is negative (the rotational angular speed of the drum is lower than the predetermined value), the transfer speed is reduced to produce a coarser transferred image (the interval in the sub-scanning direction is increased=the pitch interval is increased). It should be noted that although FIG. 3 shows variation in rotation of the photosensitive drum during one rotation (one repetition period) thereof, actually, the variation in rotation occur periodically since the photosensitive drum is rotating).

If profiles of misregistrations or displacements caused by variations in the rotations of the photosensitive drums 2*a*, 2*b*, 2*c*, and 2*d* can be caused to coincide with each other, although absolute positions of colors with respect to a sheet remain displaced, relative displacements between the colors can be reduced (ideally to 0). In general, in an image formed by the image forming apparatus, relative positional displacements between the colors are liable to be more conspicuous than absolute positional displacements of colors with respect to a sheet, and therefore registration of the relative positions of the colors is very effective means for enhancing image quality.

To cause the profiles of displacements due to the variation in rotations of the photosensitive drums 2*a*, 2*b*, 2*c*, and 2*d* to coincide with each other, the center-to-center distance between the drums is set to integral multiples of the length (circumference) of the outer periphery of each drum, and make the respective rotational phases of the photosensitive drums in phase.

Next, a method of making the respective rotational phases of the photosensitive drums in phase will be described with reference to FIGS. 4A to 4E. Now, the diameter of the photosensitive drums 2*a*, 2*b*, 2*c*, and 2*d* is represented by D, the distance between the drums is represented by πD, and it is assumed that toner denoted by a black circle is transferred from the leftmost photosensitive drum 2*a* to the intermediate transfer belt 8, and the intermediate transfer belt 8 is conveyed in the right direction, as viewed in FIGS. 4A to 4E. Further, it is assumed that the rotational phases of the photosensitive drums 2*a*, 2*b*, 2*c*, and 2*d* are made in phase.

Figures 4A, 4B, 4C, 4D, 4E:
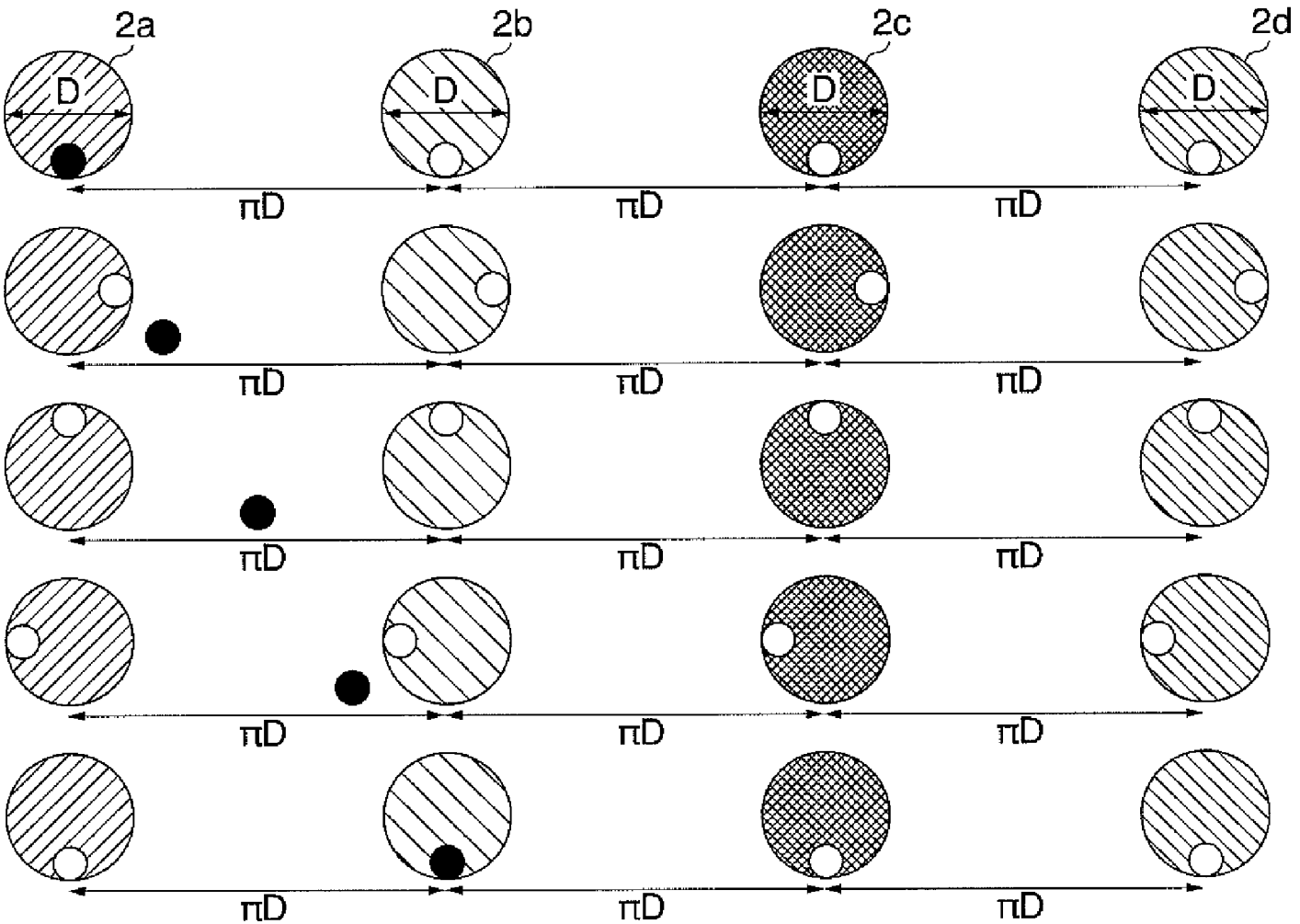
FIGS. 4A to 4E are diagrams useful in explaining conditions for making the respective rotational phases of the photosensitive drums in phase.

As shown in FIG. 4A, the toner of the photosensitive drum 2*a* is transferred onto the intermediate transfer belt 8. FIGS. 4B to 4E show states in which the photosensitive drums 2*a*, 2*b*, 2*c*, and 2*d* rotate, and the toner on the intermediate transfer belt 8 is conveyed.

When the photosensitive drums 2*a*, 2*b*, 2*c*, and 2*d* each perform one rotation after the toner of the photosensitive drum 2*a* is transferred onto the intermediate transfer belt 8, and the toner transferred onto the intermediate transfer belt 8 by the photosensitive drum 2*a* reaches the photosensitive drum 2*b*, the rotational phases of the photosensitive drums are in phase. This is because the circumferential speed of the photosensitive drums 2*a*, 2*b*, 2*c*, and 2*d*, and the conveying speed at which the toner is conveyed coincide with each other, and the distance between the drums is equal to πD.

Now, since the distance between the drums is assumed to be πD, the toner reaches the photosensitive drum 2*b* from the photosensitive drum 2*a* when each drum performs one rotation. If the distance between the drums is set to NπD (N is a natural number), when each drum performs N rotations, the toner reaches the photosensitive drum 2*b*.

Similarly, the rotational phases of the photosensitive drums 2*c* and 2*d* are also in phase, and the toners from the photosensitive drums 2*a*, 2*b*, 2*c*, and 2*d* at the same phase are superposed one upon another. The conditions for making the respective rotational phases of the photosensitive drums in phase and superposing the toners one upon another are the setting of the center-to-center distance between the drums to integral multiples of the length of the outer periphery of each drum and making the respective rotational phases of the photosensitive drums in phase.

The center-to-center distance between the photosensitive drums 2*a*, 2*b*, 2*c*, and 2*d* is unconditionally determined by mounting positions of the drums on the apparatus. As to the rotational phases of the photosensitive drums, however, it is impossible to make them in phase without control thereon, since each photosensitive drum has a degree of freedom.

Next, a description will be given of an example of control for making the rotational phases of the photosensitive drums 2*a*, 2*b*, 2*c*, and 2*d* in phase.

Figure 5:
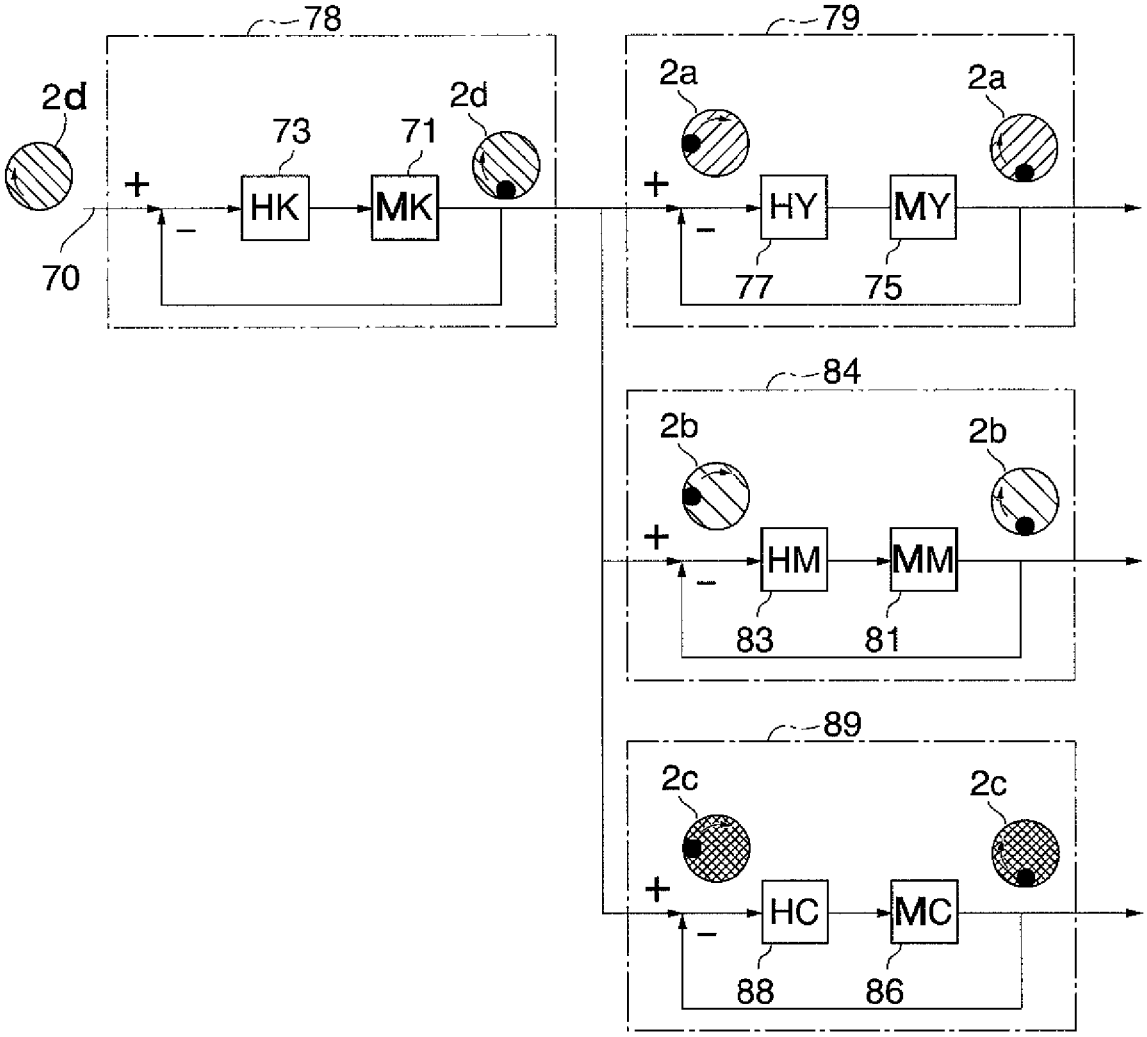
FIG. 5 is a block diagram which is useful in explaining control sections for controlling rotational speeds and rotational phases of the photosensitive drums.

FIG. 5 is a block diagram which is useful in explaining control sections for controlling the rotational speeds and rotational phases of the photosensitive drums 2*a*, 2*b*, 2*c*, and 2*d*. It should be noted that here, the description is given with reference to the photosensitive drum 2*d*.

A reference signal 70 with reference to which the rotational speed of the photosensitive drum 2*d* is controlled is input to the control section (control unit) 78 of the photosensitive drum 2*d*. In the present embodiment, to cause the photosensitive drums 2*a*, 2*b*, 2*c*, and 2*d* to rotate at a speed synchronous with the intermediate transfer belt 8, the reference signal 70 as the reference of the rotational speed is detected e.g. by a sensor (rotary encoder) 38 shown in FIGS. 6A and 6B. This sensor (second detecting unit) 38 is comprised of an encoder 37 mounted on a drive source of the intermediate transfer belt 8, and a photointerrupter 36 for detecting a rotating state of the encoder 37, and is configured to be capable of delivering one pulse of the signal per one rotation of the encoder 37.

The control section 78 of the photosensitive drum 2*d* controls the speed of the photosensitive drum 2*d* that generates a reference signal of the rotational phase (rotational phase reference signal) with respect to the reference signal 70 of the rotational speed. In the control section 78, a controller 73 controls a drive motor 71 such that the difference between the rotational speed signal indicative of the rotational speed of the photosensitive drum 2*d* (rotational phase reference signal) and the reference signal 70 of the rotational speed is eliminated.

Figure 6A:
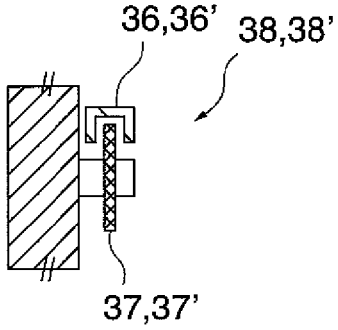
FIGS. 6A and 6B are diagrams showing an example of a sensor for detecting the rotational speed of each of the photosensitive drums and an intermediate transfer belt.
Figure 6B:
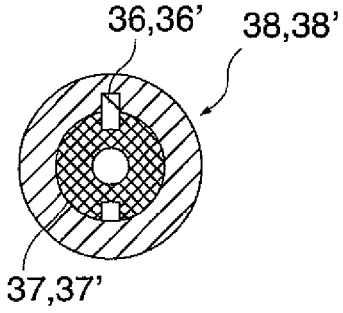
Figure 7:
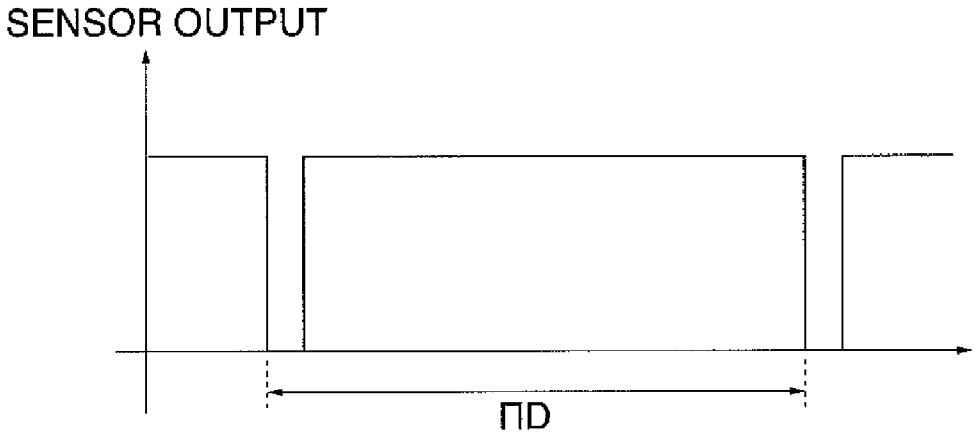
FIG. 7 is a diagram showing a signal delivered from the sensor shown in FIGS. 6A and 6B.

The rotational phase reference signal of the photosensitive drum 2*d* can be generated by a sensor 38' having the same construction as the above-mentioned sensor (rotary encoder) 38 which is comprised, as shown in FIGS. 6A and 6B, of an encoder 37' directly connected to the shaft of the photosensitive drum 2*d*, and a photointerrupter 36', whereby the rotational speed of the photosensitive drum 2*d* can be taken out as a repetition period of the pulse of the rotational phase reference signal delivered from the sensor 38' (see FIG. 7). The drive motor 71 is controlled by the controller 73 such that the repetition period of the pulse of the rotational phase reference signal delivered from the sensor (first detecting unit) 38' mounted on the photosensitive drum 2*d*, and the repetition period of the pulse of the reference signal 70 satisfy a predetermined relationship.

In the case of the control section 78, the predetermined relationship is defined as coincidence between the repetition period of the pulse of the rotational phase reference signal and that of the pulse of the reference signal 70. Thus, the speed of the photosensitive drum 2*d*, which is used as a reference photosensitive drum, is controlled, and at the same time a phase of the photosensitive drum 2*d* with reference to which the rotational phases of the photosensitive drums 2*a*, 2*b*, and 2*c* are made in phase is determined.

Control sections (control units) 79, 84, and 89 control the photosensitive drums 2*a*, 2*b*, and 2*c* such that they have the same rotational speed and the same rotational phase as those of the photosensitive drum 2*d* as the reference photosensitive drum. The control section 78 provides a so-called speed follow-up system control for causing the rotational speed of the photosensitive drum to coincide with a reference rotational speed, whereas the control sections 79, 84, and 89 each provide a so-called position follow-up system control for causing the position of the photosensitive drum to coincide with a reference position.

Figures 9A, 9B, 9C, 9D:
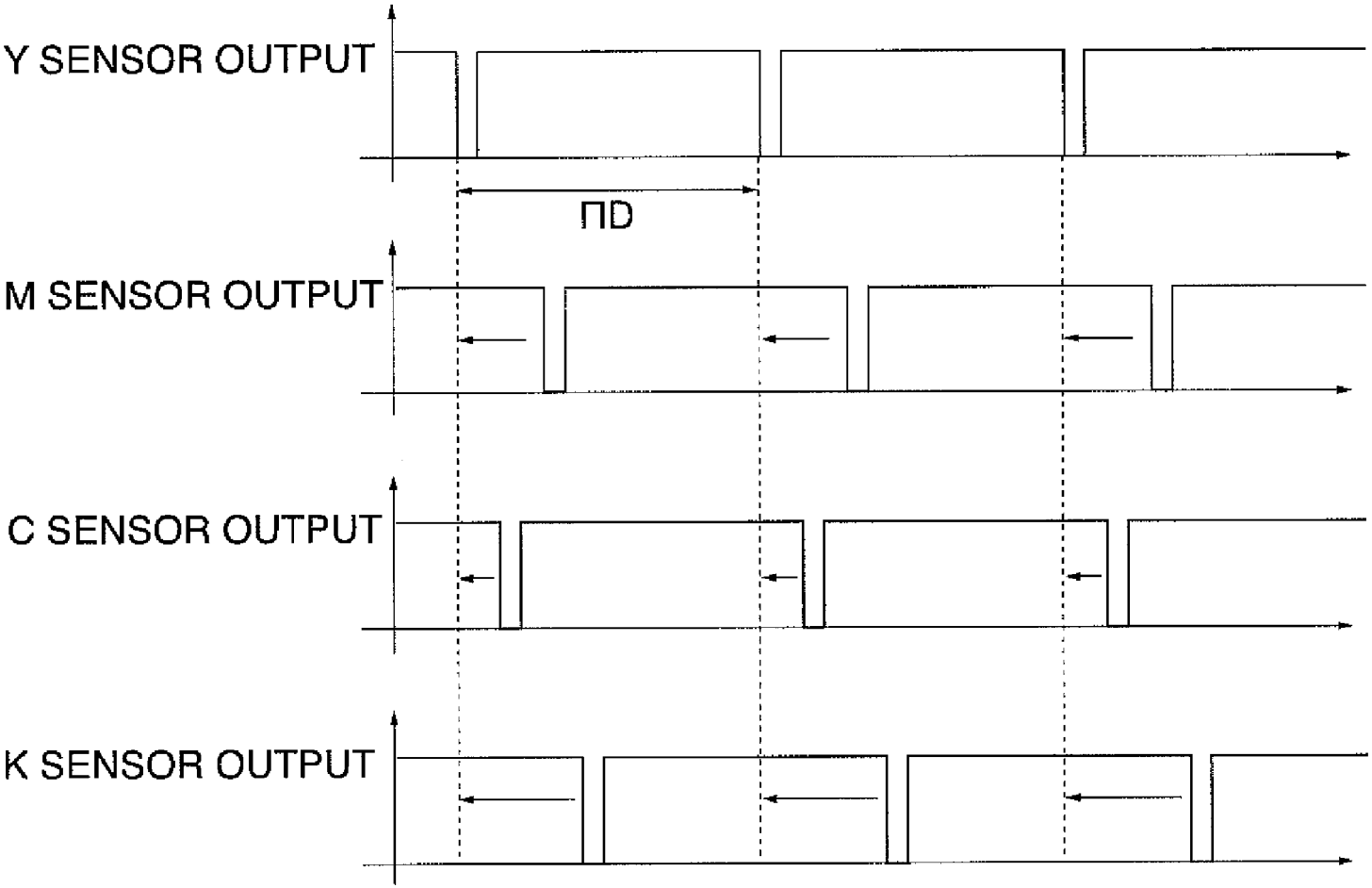
FIGS. 9A to 9D are diagrams showing signals delivered from rotational speed sensors amounted on the respective photosensitive drums.

In the present embodiment, the rotational phase reference signal input to the control sections 79, 84, and 89 is delivered from the sensor 38' shown in FIGS. 6A and 6B. In the control sections 79, 84, and 89, controllers 77, 83, and 88 control drive motors 75, 81, and 86, respectively, such that the repetition periods and rotational phases of sensor outputs (see FIG. 9) i.e. rotational speed signals from respective sensors that are mounted on the photosensitive drums 2*a*, 2*b*, and 2*c*, and each have the same construction as that of the sensor 38' formed by the rotary encoder, coincide with the repetition period and rotational phase of the input pulse of the rotational phase reference signal delivered from the sensor 38'. Actually, the control sections 79, 84, and 89 are each realized by configuring the control system such that a pulse from controlled object is made synchronous with the pulse of the rotational phase reference signal.

Figure 8A:
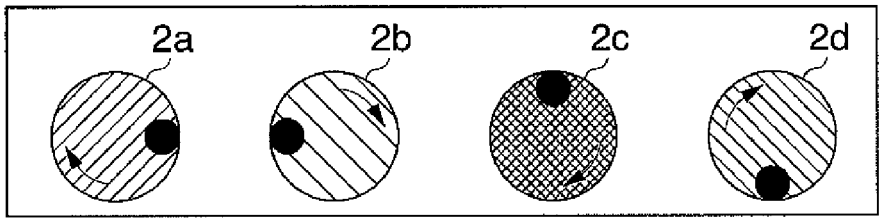
FIGS. 8A to 8D are diagrams showing states of control for making the respective rotational phases of the photosensitive drums in phase.
Figure 8B:
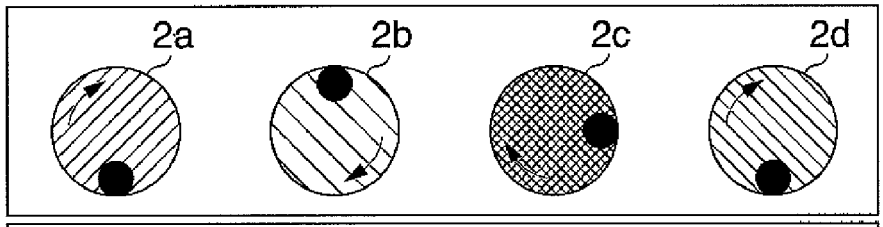
Figure 8C:
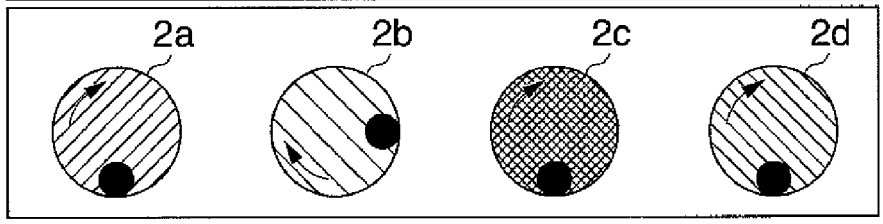
Figure 8D:
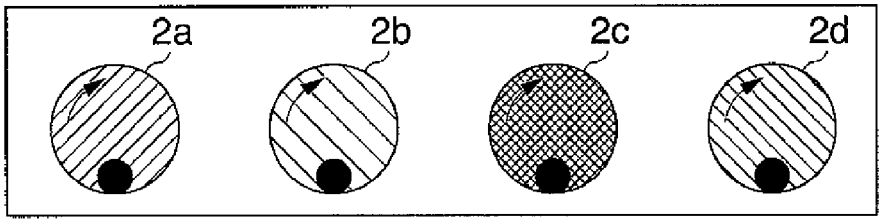

FIGS. 8A to 8D are diagrams showing a state of control for making the rotational phases of the photosensitive drums 2*a*, 2*b*, 2*c*, and 2*d*, coincident (in phase) with each other. In FIGS. 8A to 8D, black circles indicate the reference phase. FIG. 8A shows an initial state of the control. Here, as the control using the photosensitive drum 2*d* as the reference photosensitive drum proceeds from the FIG. 8A state sequentially to respective states shown in FIGS. 8B, 8C, and 8D, the rotational phases of the photosensitive drums 2*a*, 2*b*, and 2*c* are progressively made coincident with that of the photosensitive drum 2*d*.

Figure 10:
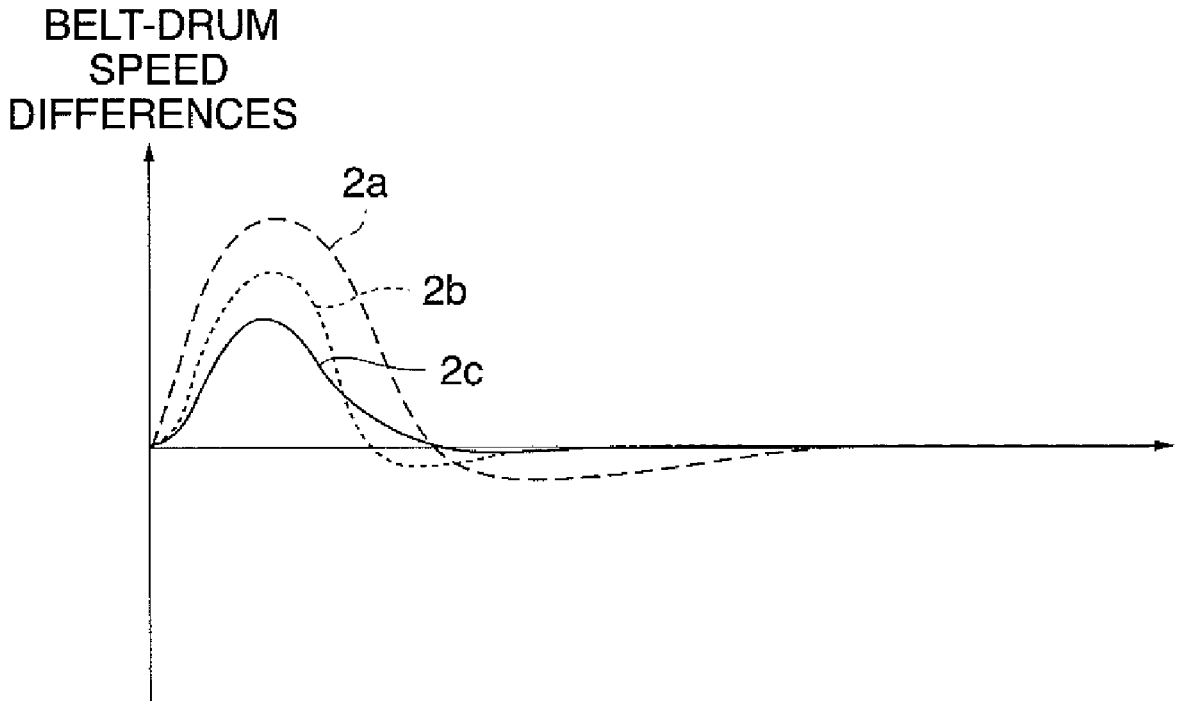
FIG. 10 shows examples of speed differences between the photosensitive drums and the intermediate transfer belt.

FIG. 10 shows examples of the respective differences of rotational speeds (speed differences) of the photosensitive drums 2*a*, 2*b* and 2*c*, with respect to the intermediate transfer belt 8, during the above-described rotational speed control and rotational phase control of the photosensitive drums 2*a*, 2*b*, 2*c*, and 2*d*. It should be noted that since the photosensitive drum 2*d* is used as the reference of the rotational phase, the respective speed differences of the photosensitive drums 2*a*, 2*b* and 2*c*, with respect to the intermediate transfer belt 8 are shown in FIG. 10.

As is apparent from FIG. 10, when the rotational speed control and rotational phase control of the photosensitive drums 2*a*, 2*b*, 2*c*, and 2*d* are started, the speed differences of the photosensitive drums 2*a*, 2*b* and 2*c*, with respect to the intermediate transfer belt 8 progressively increase. The speed difference varies between the photosensitive drums 2*a*, 2*b*, and 2*c* mainly because the photosensitive drums 2*a*, 2*b*, and 2*c* have different initial rotational phases, and are different in load thereof. As the control proceeds, the rotational speeds of the photosensitive drums 2*a*, 2*b*, and 2*c* become equal to that of the intermediate transfer belt 8, and the rotational phases of the photosensitive drums 2*a*, 2*b*, 2*c*, and 2*d* become coincident to eliminate the speed difference.

By the way, if the speed differences of the photosensitive drums 2*a*, 2*b* and 2*c* with respect to the intermediate transfer belt 8 occur in a state in which the photosensitive drums 2*a*, 2*b* and 2*c* are in contact with the intermediate transfer belt 8, there occur slips therebetween.

The slips damage the surfaces of the photosensitive drums 2*a*, 2*b* and 2*c*, and the intermediate transfer belt 8, and when the damages are accumulated, the damages comet to appear on a print image as vertical streaks and periodic density variation, which spoils image quality.

Further, the slips act on the drive sources of the photosensitive drums 2*a*, 2*b* and 2*c* and that of the intermediate transfer belt 8 such that loads on the drive sources become larger, which leads to increases in the load capacities and drive energies of the drive sources.

It is impossible to avoid occurrence of slips between the photosensitive drums 2*a*, 2*b* and 2*c*, and the intermediate transfer belt 8 insofar as the rotational phases of the photosensitive drums 2*a*, 2*b* and 2*c* are controlled in the state in which the photosensitive drums 2*a*, 2*b* and 2*c* are in contact with the intermediate transfer belt 8.

To solve this problem, in the present embodiment, the slips between the photosensitive drums 2*a*, 2*b* and 2*c*, and the intermediate transfer belt 8 are suppressed within a certain range, whereby the damages to the photosensitive drums 2*a*, 2*b* and 2*c*, and the intermediate transfer belt 8 are reduced to reduce the loads on the drive sources.

Hereinafter, a detailed description will be given of a method of reducing the damages and the loads on the drive sources.

Figure 11:
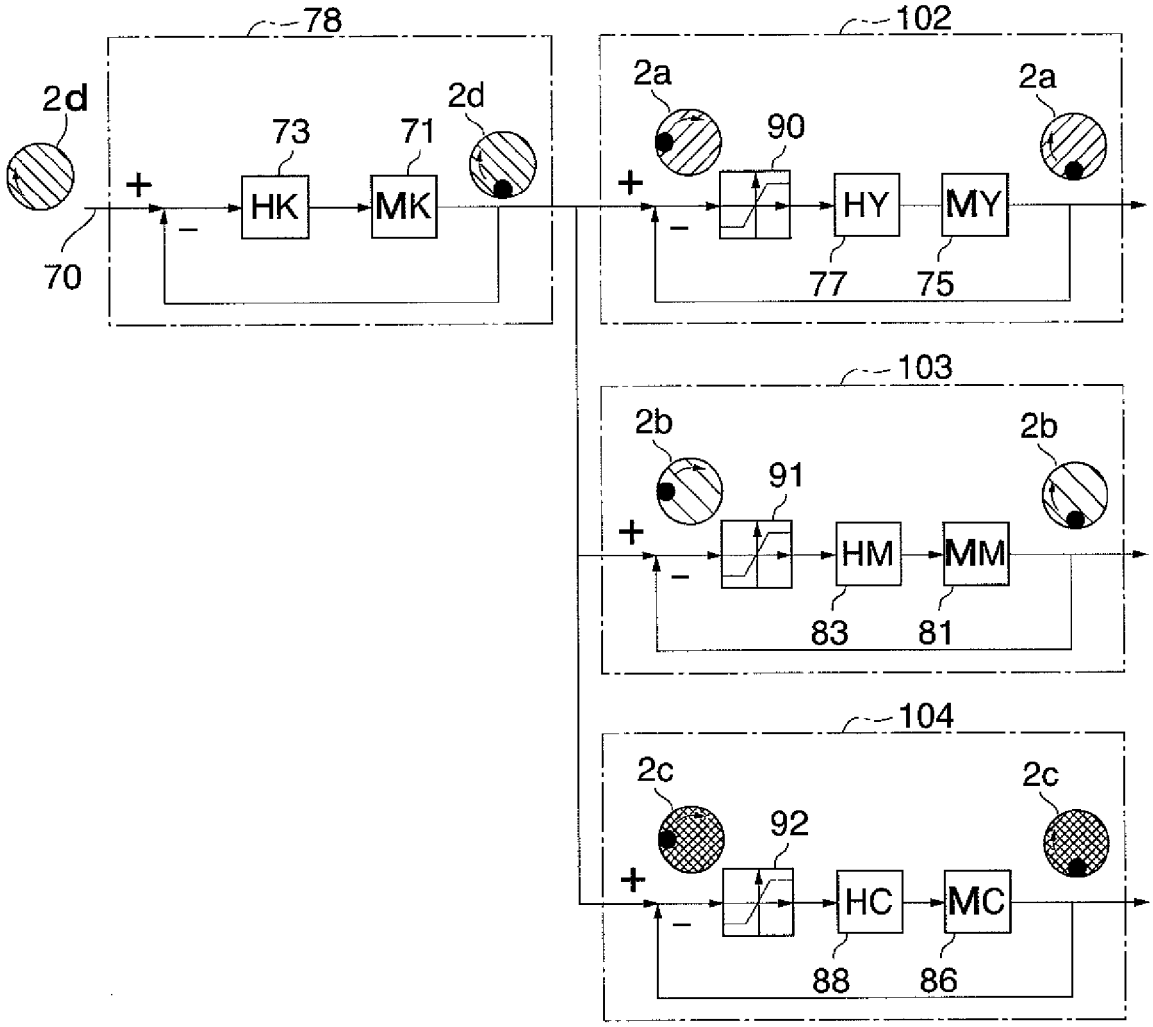
FIG. 11 is a block diagram which is useful in explaining control sections for controlling the rotational speeds and the rotational phases of the photosensitive drums.

FIG. 11 is a block diagram which is useful in explaining the control sections for controlling the rotational speed and the respective rotational phases of the photosensitive drums 2*a*, 2*b*, 2*c*, 2*d*. It should be noted that components identical to those of the photosensitive drums appearing in FIG. 5 are denoted by identical reference numerals.

Control sections (control units) 102, 103, and 104 for controlling the rotational phases of the photosensitive drums 2*a*, 2*b*, and 2*c* limit the difference between the rotational speed signals therefrom and the reference signal 70 by limiters (limit units) 90, 91, and 92. This limits the rotational speeds of the photosensitive drums 2*a*, 2*b*, and 2*c* to thereby limit the respective speed differences of the photosensitive drums 2*a*, 2*b* and 2*c*, with respect to the intermediate transfer belt 8.

Figure 12:
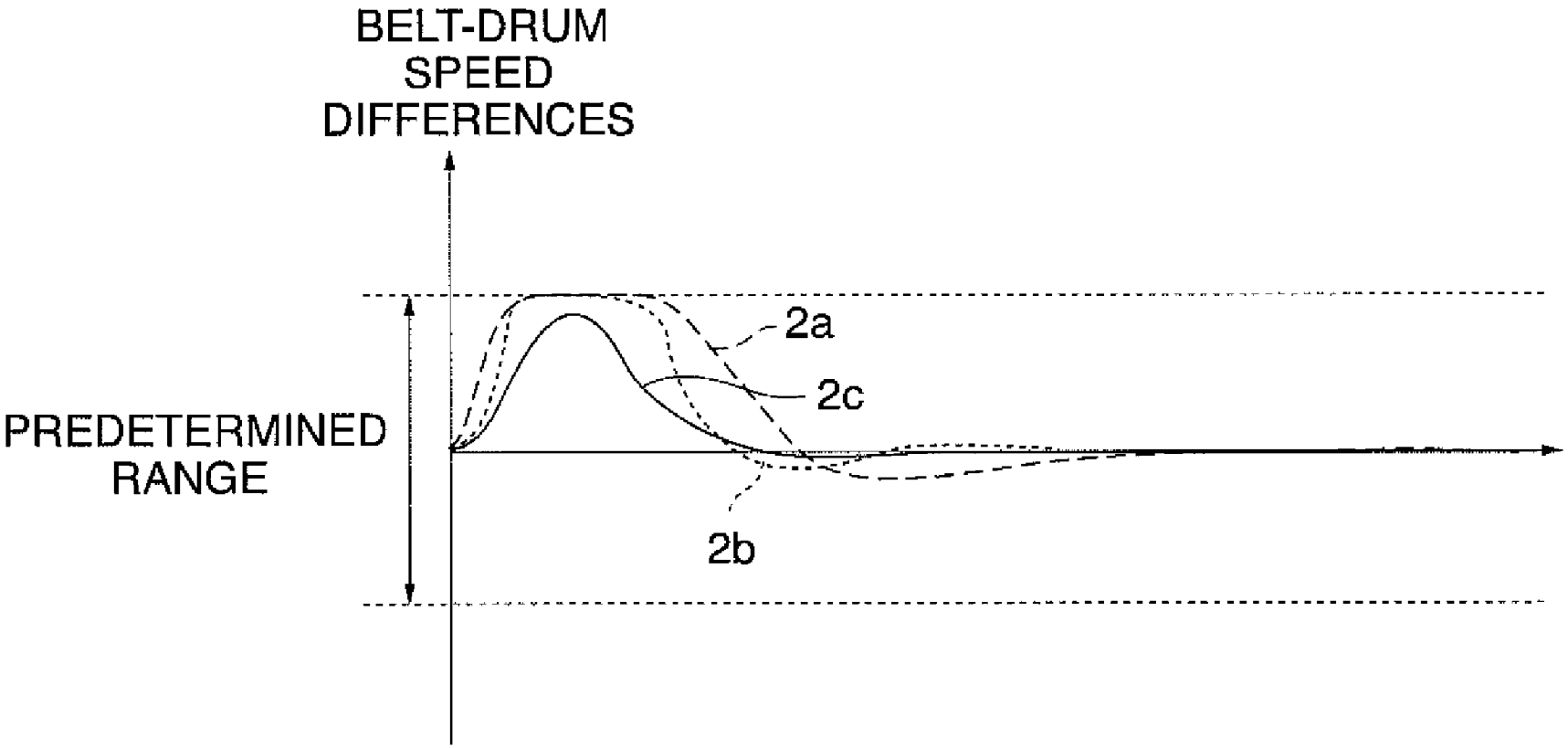
FIG. 12 shows the speed differences between the photosensitive drums and the intermediate transfer belt, which appear when the rotational phases of the photosensitive drums are controlled by control sections provided with limiters.

FIG. 12 shows the respective speed differences of the photosensitive drums 2*a*, 2*b* and 2*c*, with respect to the intermediate transfer belt 8, which occur when the rotational phases of the photosensitive drums 2*a*, 2*b*, and 2*c* are controlled by the control sections 102, 103, and 104 provided with the limiters 90, 91, and 92. It is understood from FIG. 12 that the speed differences between the photosensitive drums 2*a*, 2*b* and 2*c*, and the intermediate transfer belt 8 are suppressed within a certain range by providing the limiters 90, 91, and 92.

This makes it possible to reduce the damages of the photosensitive drums 2*a*, 2*b* and 2*c*, and the intermediate transfer belt 8 due to slips therebetween, and reduce the loads on the drive sources of the photosensitive drums 2*a*, 2*b* and 2*c* and the intermediate transfer belt 8.

Figure 13A:
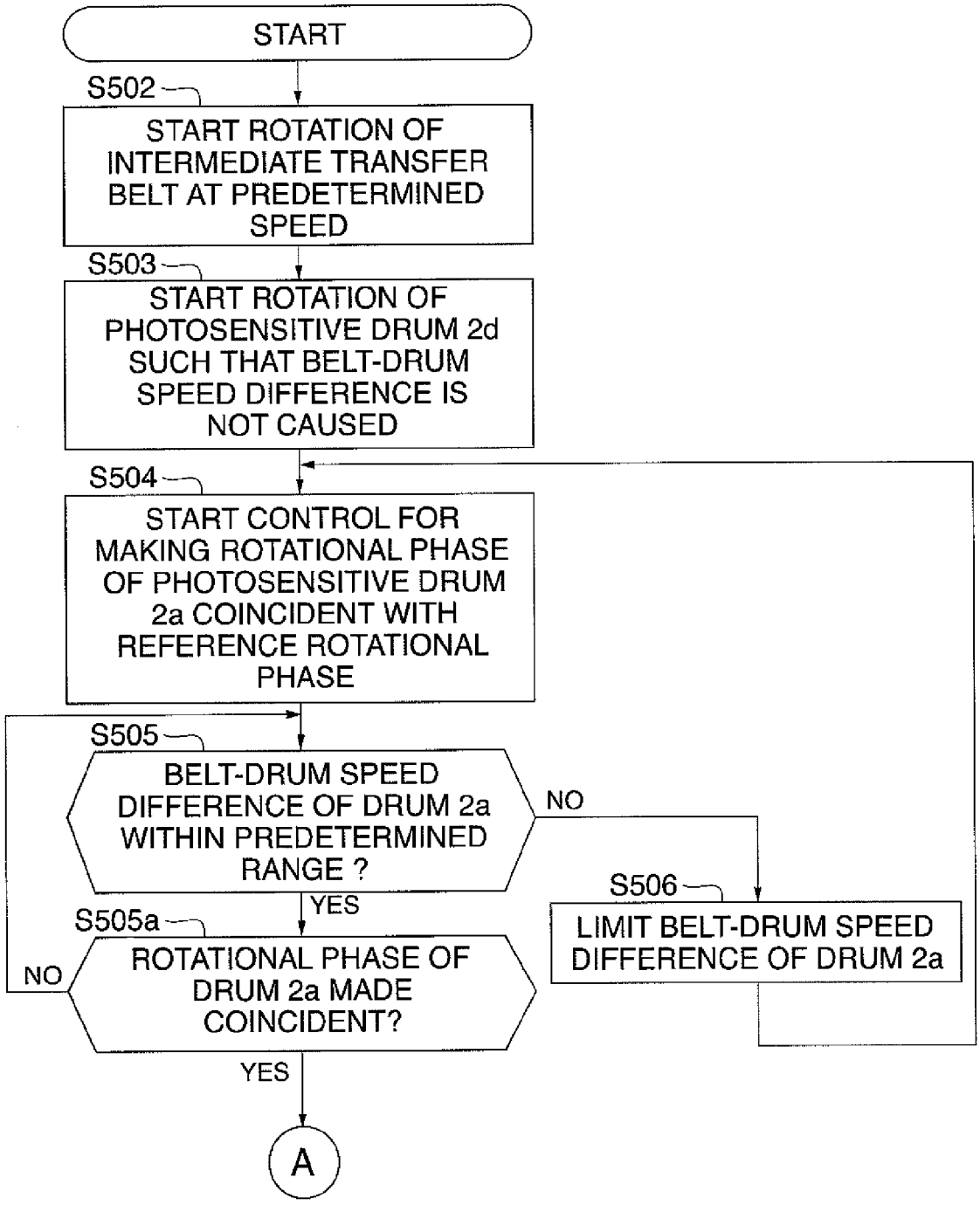
FIGS. 13A and 13B are flowcharts of a rotation control process for controlling the rotational speeds and rotational phases of the photosensitive drums by the FIG. 11 control sections of the image forming apparatus.
Figure 13B:
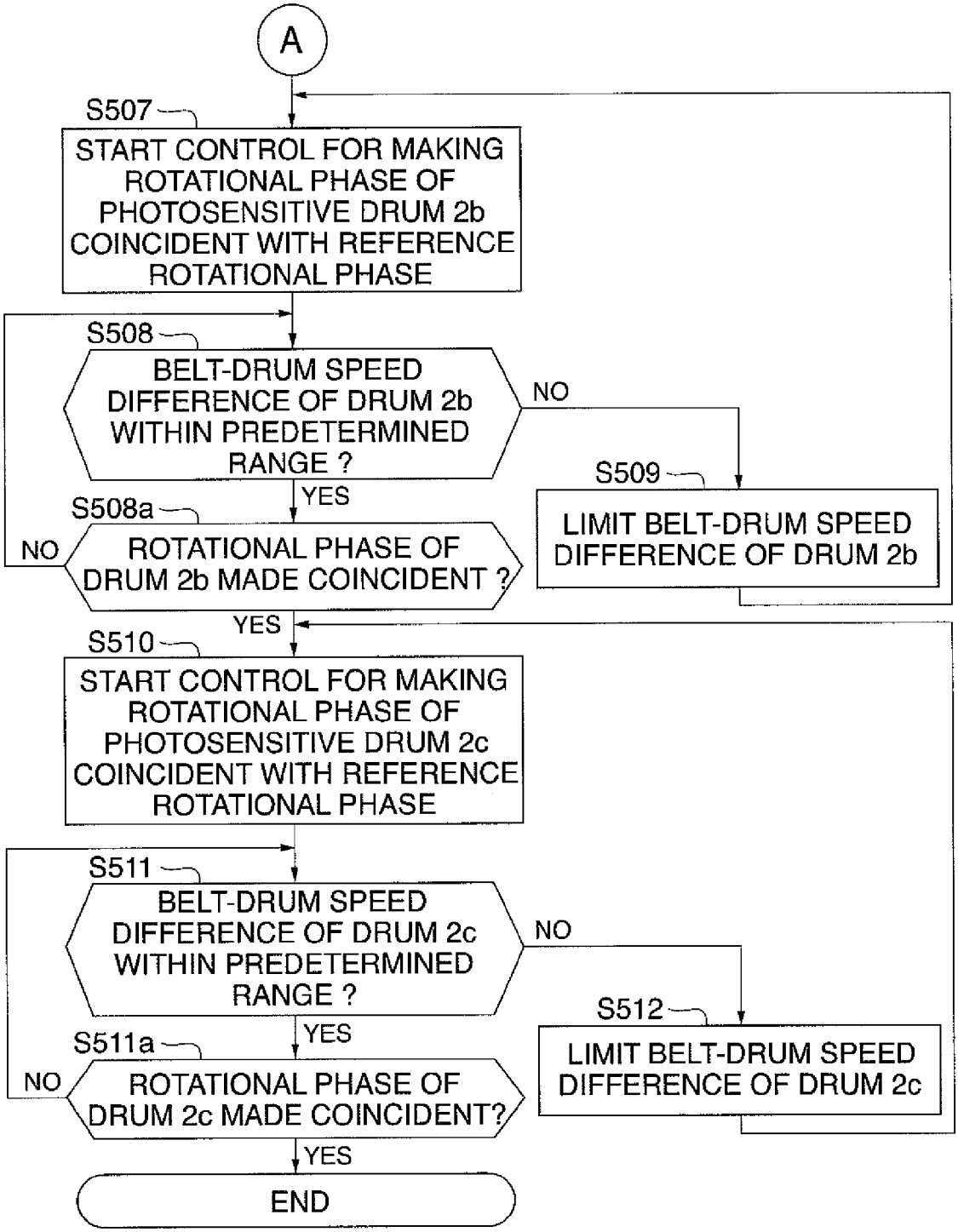

Next, a rotation control process for controlling the rotational speeds and rotational phases of the photosensitive drums 2*a*, 2*b*, 2*c*, and 2*d* by the FIG. 11 control sections of the image forming apparatus according to the present embodiment will be described with reference to FIGS. 13A and 13B.

First, in a step S502, the drive source of the intermediate transfer belt 8 is driven to rotate the intermediate transfer belt 8 at a predetermined speed, and in a step S503, the drive motor 71 of the photosensitive drum 2*d* as the reference photosensitive drum is driven to rotate the photosensitive drum 2*d*. At this time, the drive motor 71 is controlled by the controller 73 such that no speed difference is caused between the intermediate transfer belt 8 and the photosensitive drum 2*d*, i.e. that the reference signal 70 and the rotational speed signal (rotational phase reference signal) from the photosensitive drum 2*d* coincide with each other. It should be noted that although the steps S502 and S503 are sequentially shown, actually, the steps are simultaneously carried out. Further, although the photosensitive drum 2*d* is used as the reference photosensitive drum, this is not limitative, but any other photosensitive drum 2*a*, 2*b*, or 2*c* may be used as the reference photosensitive drum.

Next, rotational phase-coinciding processes in steps S504 to 512 are carried out. It should be noted that although the rotational phase-coinciding process in the steps S504 to S506, the rotational phase-coinciding process in the steps S504 to S506, the process in the steps S507 to S509, and the rotational phase-coinciding process in the steps S510 to S512 are sequentially shown, actually, these processes are simultaneously carried out.

In the step S504, when the speed difference between the intermediate transfer belt 8 and the photosensitive drum 2*d* has been eliminated, or before the speed difference has been eliminated, the controller 77 drives the drive motor 75 to start the rotational phase-coinciding process for making the rotational phase of the photosensitive drum 2*a* coincident with that of the photosensitive drum 2*d*.

Then, in the step S505, the limiter 90 determines whether or not the speed difference between the photosensitive drum 2*a* and the intermediate transfer belt 8 is within a predetermined range. If the speed difference is within the predetermined range, the process proceeds to a step S505*a*, whereas if the speed difference is not within the predetermined range, the process proceeds to the step S506.

In the step S506, the limiter 90 limits the speed difference to cause the controller 77 to control the drive motor 75 such that the speed of the photosensitive drum 2*a* is limited.

On the other hand, in the step S505*a*, it is determined whether or not the rotational phase of the photosensitive drum 2*a* has been made coincident with that of the photosensitive drum 2*d*. If the rotational phase of the photosensitive drum 2*a* has not been made coincident with that of the photosensitive drum 2*d* yet, the process returns to the step S505 so as to continue the rotational phase-coinciding process for the photosensitive drum 2*a* until the rotational phase of the photosensitive drum 2*a* has been made coincident with that of the photosensitive drum 2*d*, whereas if the rotational phase of the photosensitive drum 2*a* has already been made coincident with that of the photosensitive drum 2*d*, the rotational phase-coinciding process for the photosensitive drum 2*a* is terminated.

Further, in the step S507, the controller 83 drives the drive motor 81 to start the rotational phase-coinciding process for making the rotational phase of the photosensitive drum 2*b* coincident with that of the photosensitive drum 2*d*.

Then, in the step S508, the limiter 91 determines whether or not the speed difference between the photosensitive drum 2*b* and the intermediate transfer belt 8 is within the predetermined range. If the speed difference is within the predetermined range, the process proceeds to a step S508*a*, whereas if the speed difference is not within the predetermined range, the process proceeds to the step S509.

In the step S509, the limiter 91 limits the speed difference to cause the controller 83 to control the drive motor 81 such that the speed of the photosensitive drum 2*b* is limited.

On the other hand, in the step S508*a*, it is determined whether or not the rotational phase of the photosensitive drum 2*b* has been made coincident with that of the photosensitive drum 2*d*. If the rotational phase of the photosensitive drum 2*b* has not been made coincident with that of the photosensitive drum 2*d* yet, the process returns to the step S508 so as to continue the rotational phase-coinciding process for the photosensitive drum 2*b* until the rotational phase of the photosensitive drum 2*b* has been made coincident with that of the photosensitive drum 2*d*, whereas if the rotational phase of the photosensitive drum 2*b* has already been made coincident with that of the photosensitive drum 2*d*, the rotational phase-coinciding process for the photosensitive drum 2*b* is terminated.

Furthermore, in the step S510, the controller 88 drives the drive motor 86 to start the rotational phase-coinciding process for making the rotational phase of the photosensitive drum 2*c* coincident with that of the photosensitive drum 2*d*.

Then, in the step S511, the limiter 92 determines whether or not the speed difference between the photosensitive drum 2*c* and the intermediate transfer belt 8 is within the predetermined range. If the speed difference is within the predetermined range, the process proceeds to a step S511*a*, whereas if the speed difference is not within the predetermined range, the process proceeds to the step S512.

In the step S512, the limiter 92 limits the speed difference to cause the controller 88 to control the drive motor 86 such that the speed of the photosensitive drum 2*c* is limited.

On the other hand, in the step S511*a*, it is determined whether the rotational phase of the photosensitive drum 2*c* has been made coincident with that of the photosensitive drum 2*d*. If the rotational phase of the photosensitive drum 2*c* has not been made coincident with that of the photosensitive drum 2*d* yet, the process returns to the step S511 so as to continue the rotational phase-coinciding process for the photosensitive drum 2*c* until the rotational phase of the photosensitive drum 2*c* has been made coincident with that of the photosensitive drum 2*d*, whereas if the rotational phase of the photosensitive drum 2*c* has already been made coincident with that of the photosensitive drum 2*d*, the rotational phase-coinciding process for the photosensitive drum 2*c* is terminated.

It should be noted that although in the present embodiment, the description has been given, by way of example of the case where the intermediate transfer belt 8 and the photosensitive drums 2*a*, 2*b*, 2*c*, and 2*d* can all be driven independently of each other, this is not limitative.

Figure 14:
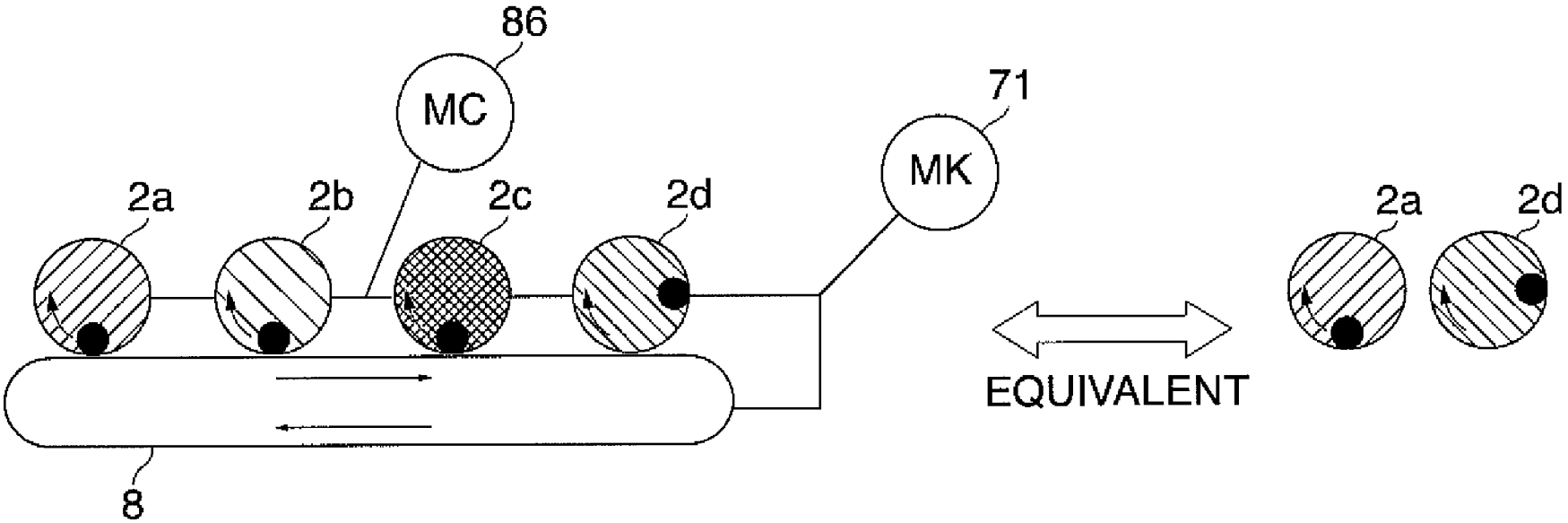
FIG. 14 is a diagram useful in explaining a variation of the image forming apparatus according to the first embodiment of the present invention.

For example, as in a variation of the present embodiment shown in FIG. 14, the intermediate transfer belt 8 and one (e.g. the photosensitive drum 2*d*) of the photosensitive drums 2*a*, 2*b*, 2*c*, and 2*d* are caused to operate in a synchronous manner without causing any slip therebetween using the drive motor 71 as a common drive source. Further, using the drive motor 86 as a common drive source for the other three photosensitive drums 2*a*, 2*b*, and 2*c*, whereby the rotational phases of the photosensitive drums 2*a*, 2*b*, and 2*c* may be made coincident with each other.

Figure 15:
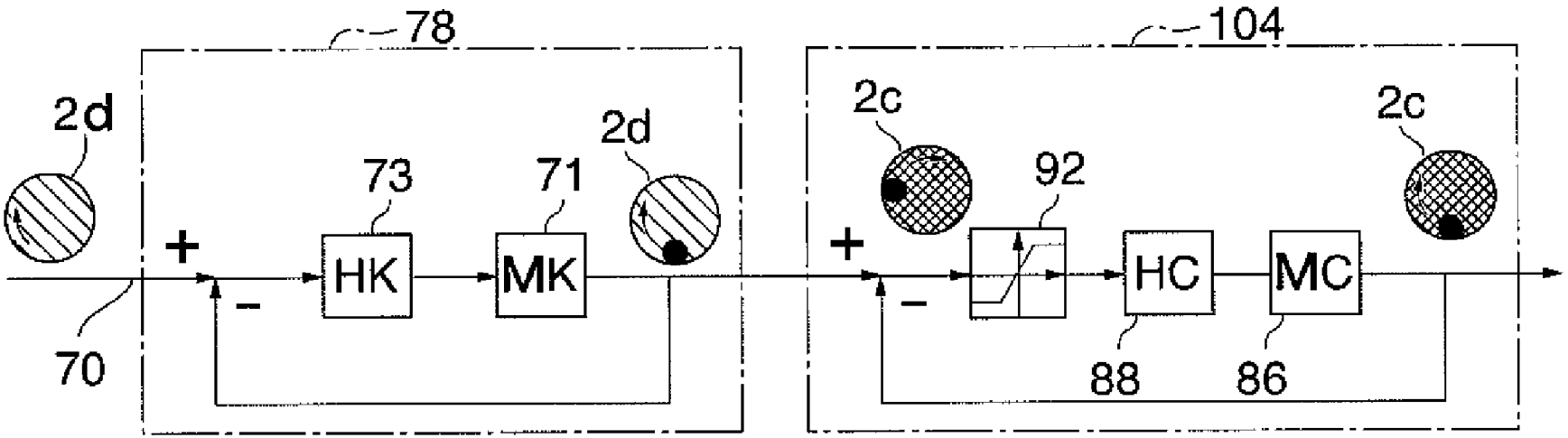
FIG. 15 is a block diagram useful in explaining the variation of the image forming apparatus.

This makes it possible to simplify the control operations for the intermediate transfer belt 8 and the photosensitive drums 2*a*, 2*b*, 2*c*, and 2*d* into two control operations, i.e. the speed control of the intermediate transfer belt 8 and the photosensitive drum 2*d*, and the rotational phase control of the photosensitive drums 2*a*, 2*b* and 2*c*, with respect to the photosensitive drum 2*d*. More specifically, as shown in FIG. 15, by way of example, it is possible to simplify the control operations into two control operations by the control sections 78 and 104 described above with reference to FIG. 11. It should be noted that the operations of the control sections 78 and 104 are the same as described above, and detailed description thereof is omitted.

Next, an image forming apparatus according to a second embodiment of the present invention will be described with reference to FIGS. 16 to 21. It should be noted that components identical or corresponding to those of the first embodiment are designated by identical reference numerals, and description thereof is omitted or simplified.

Although in the above-described first embodiment, the rotational phases of the three photosensitive drums 2*a*, 2*b* and 2*c* are simultaneously controlled, if the speed differences between the photosensitive drums 2*a*, 2*b* and 2*c*, with respect to the intermediate transfer belt 8 simultaneously occur, it sometimes increases damage to the intermediate transfer belt 8 and the loads on the drive sources of the photosensitive drums 2*a*, 2*b* and 2*c* and the intermediate transfer belt 8.

To solve this problem, in the present embodiment, the rotational phase control of the photosensitive drums 2*a*, 2*b* and 2*c* is dispersed, whereby damage to the intermediate transfer belt 8 and the loads on the above drive sources are reduced.

Figure 16:
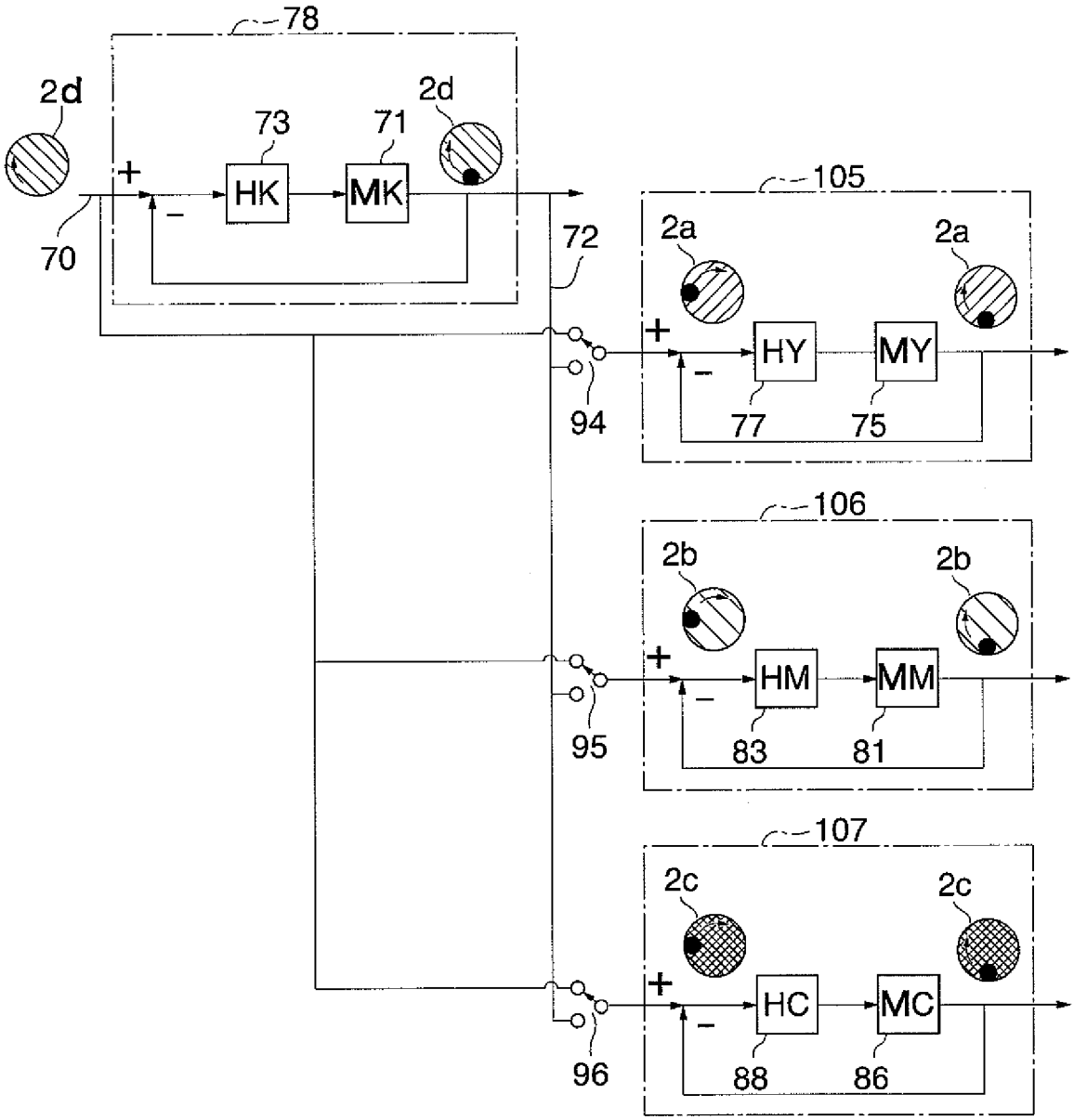
FIG. 16 is a block diagram useful in explaining of an image forming apparatus according to a second embodiment of the present invention.

FIG. 16 is a block diagram useful in explaining control sections for controlling the rotational speeds and rotational phases of the photosensitive drums 2*a*, 2*b*, 2*c*, and 2*d*.

As shown in FIG. 16, the photosensitive drums 2*a*, 2*b* and 2*c* are configured such that inputs to the control sections (control units) 105, 106, and 107 for controlling the rotational phases of the photosensitive drums 2*a*, 2*b*, and 2*c* are switched to the reference signal 70 of the rotational speed (rotational speed reference signal 70) or the reference signal 72 of the rotational phase (rotational phase reference signal 72) by changeover switches (switching units) 94, 95, and 96.

When the changeover switches 94, 95, and 96 are connected to the rotational speed reference signal 70, the controllers 77, 83, and 88 of the respective control sections 105, 106, and 107 drive the drive motors 75, 81, and 86 such that the rotational speed signals thereof follow up the reference signal 70 of the rotational speeds, whereby the rotational speed control is performed.

On the other hand, when the changeover switches 94, 95, and 96 are connected to the rotational phase reference signal 72, the controllers 77, 83, and 88 of the respective control sections 105, 106, and 107 drive the drive motors 75, 81, and 86 such that the rotational speed signals thereof follow up the rotational phase reference signal 72, whereby the rotational phase control is performed.

As described above, the inputs to the control sections 105, 106, and 107 are switched by the changeover switches 94, 95, and 96 between the rotational speed reference signal 70 and the rotational phase reference signal 72, whereby it is possible to shift the timing of the rotational phase control of the photosensitive drums 2*a*, 2*b*, and 2*c*.

Figure 17:
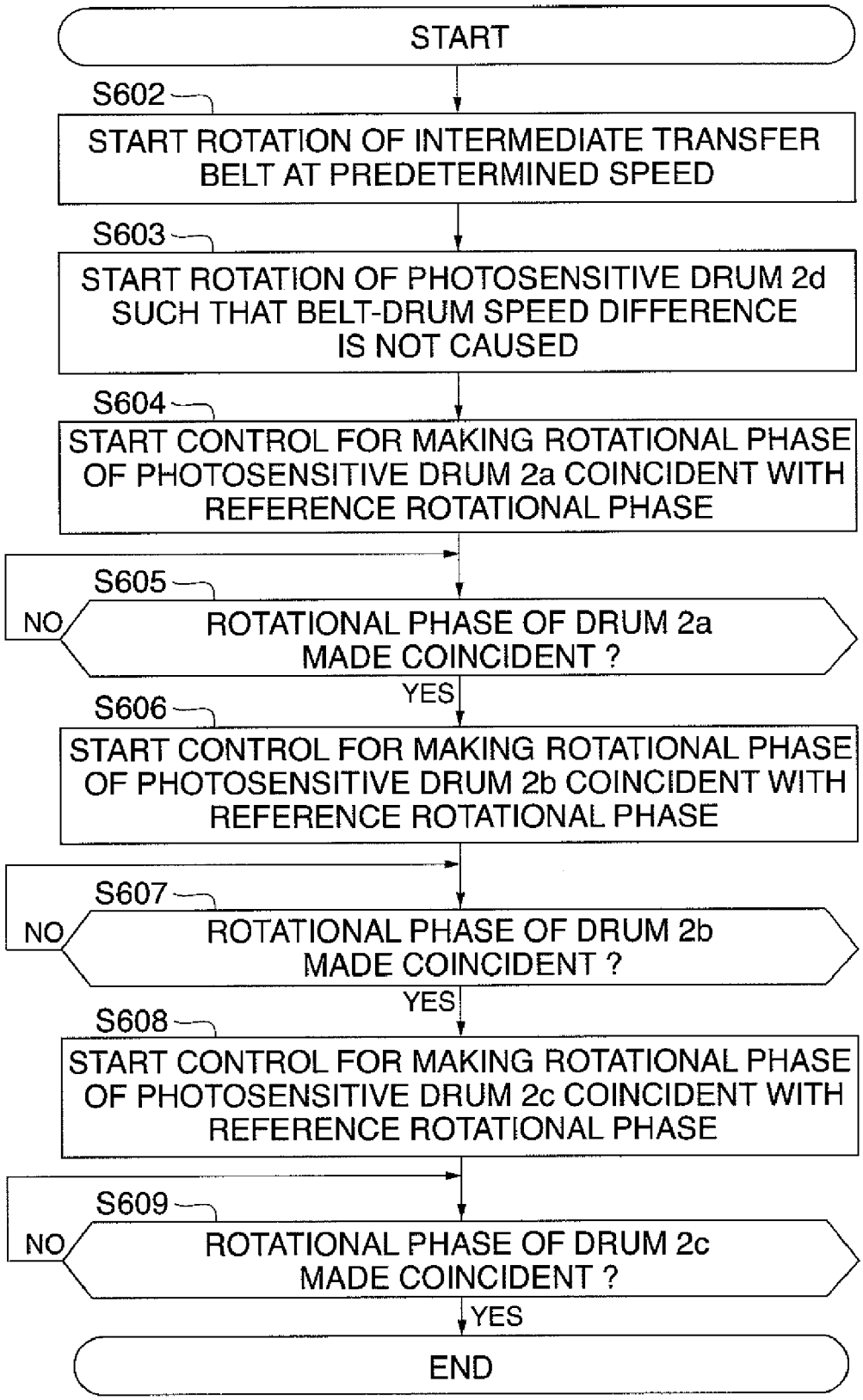
FIG. 17 is a flowchart of a rotation control process for controlling the rotational speeds and rotational phases of the photosensitive drums by the FIG. 16 control sections of the second embodiment of the present invention.

Next, a rotation control process for controlling the rotational speeds and rotational phases of the photosensitive drums 2*a*, 2*b*, 2*c*, and 2*d* by the FIG. 16 control sections of the image forming apparatus according to the present embodiment will be described with reference to FIG. 17. In the illustrated example, it is assumed that all the changeover switches 94, 95, and 96 are connected to the rotational speed reference signal 70 at the start of the control process.

First, in a step S602, the drive source of the intermediate transfer belt 8 is driven to rotate the intermediate transfer belt 8 at a predetermined speed, and in a step S603, the drive motor 71 of the photosensitive drum 2*d* as the reference photosensitive drum is driven to rotate the photosensitive drum 2*d*.

At this time, the drive motor 71 is controlled by the controller 73 such that no speed difference is caused between the intermediate transfer belt 8 and the photosensitive drum 2*d*, i.e. that the rotational speed reference signal 70 and the rotational speed signal from the photosensitive drum 2*d* coincide with each other. It should be noted that although the steps S602 and S603 are sequentially shown, actually, the steps are simultaneously carried out. Further, the reference photosensitive drum is not limited to the photosensitive drum 2*d* but any other photosensitive drum 2*a*, 2*b*, or 2*c* may be used as the reference photosensitive drum.

In a step S604, when the speed difference between the intermediate transfer belt 8 and the photosensitive drum 2*d* has been eliminated, or before the speed difference has been eliminated, the changeover switch 94 is switched to be connected to the rotational phase reference signal 72. Then, in this state, the controller 77 drives the drive motor 75 to start a rotational phase-coinciding process for making the rotational phase of the photosensitive drum 2*a* coincident with that of the photosensitive drum 2*d*.

Next, in a step S605, it is determined whether or not the rotational phase of the photosensitive drum 2*a* has been made coincident with that of the photosensitive drum 2*d*. If the rotational phase of the photosensitive drum 2*a* has not been made coincident with that of the photosensitive drum 2*d* yet, the rotational phase-coinciding process for the photosensitive drum 2*a* is continued, whereas if the rotational phase of the photosensitive drum 2*a* has already been made coincident with that of the photosensitive drum 2*d*, the process proceeds to a step S606.

In the step S606, the changeover switch 95 is switched to be connected to the rotational phase reference signal 72. In this state, the controller 83 drives the drive motor 81 to start a rotational phase-coinciding process for making the rotational phase of the photosensitive drum 2*b* coincident with that of the photosensitive drum 2*d*.

Next, in a step S607, it is determined whether or not the rotational phase of the photosensitive drum 2*b* has been made coincident with that of the photosensitive drum 2*d*. If the rotational phase of the photosensitive drum 2*b* has not been made coincident with that of the photosensitive drum 2*d* yet, the rotational phase-coinciding process for the photosensitive drum 2*b* is continued, whereas if the rotational phase of the photosensitive drum 2*b* has already been made coincident with that of the photosensitive drum 2*d*, the process proceeds to a step S608.

In the step S608, the changeover switch 96 is switched to be connected to the rotational phase signal 72. In this state, the controller 88 drives the drive motor 86 to start a rotational phase-coinciding process for making the rotational phase of the photosensitive drum 2*c* coincident with that of the photosensitive drum 2*d*.

Next, in a step S609, it is determined whether or not the rotational phase of the photosensitive drum 2*c* has been made coincident with that of the photosensitive drum 2*d*. If the rotational phase of the photosensitive drum 2*c* has not been made coincident with that of the photosensitive drum 2*d* yet, the rotational phase-coinciding process is continued, whereas if the rotational phase of the photosensitive drum 2*c* has already been made coincident with that of the photosensitive drum 2*d*, the present process is terminated.

Figure 18:
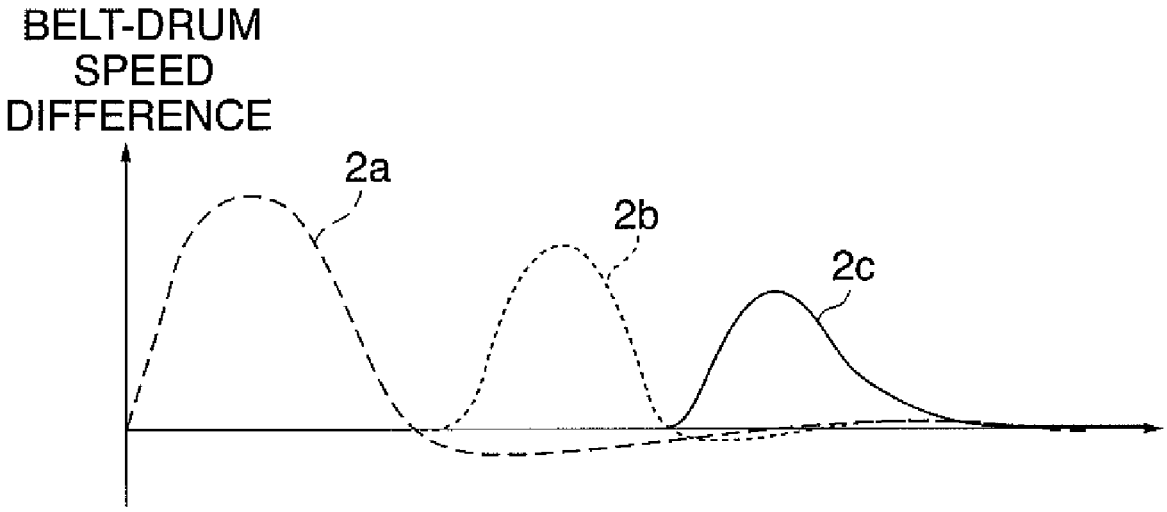
FIG. 18 is a diagram showing a graph useful in explaining a state in which timing for causing speed difference between each photosensitive drum and the intermediate transfer belt is shifted.

By performing the above-described control operations, as shown in FIG. 18, it is possible to shift timing in which the speed difference is caused between each of the photosensitive drums 2*a*, 2*b* and 2*c*, and the intermediate transfer belt 8. This makes it possible to reduce damage to the intermediate transfer belt 8, and the load on the drive source of the intermediate transfer belt 8, without providing a limiter and the like for limiting the speed difference.

It should be noted that although in the illustrated example, the photosensitive drums 2*a*, 2*b*, and 2*c* are subjected to the rotational phase-coinciding process one by one in the mentioned order, the order of photosensitive drums subjected to the rotational phase-coinciding process is not limited to this. Further, two of the photosensitive drums 2*a*, 2*b*, and 2*c* may be simultaneously subjected to the rotational phase-coinciding process.

Figure 19:
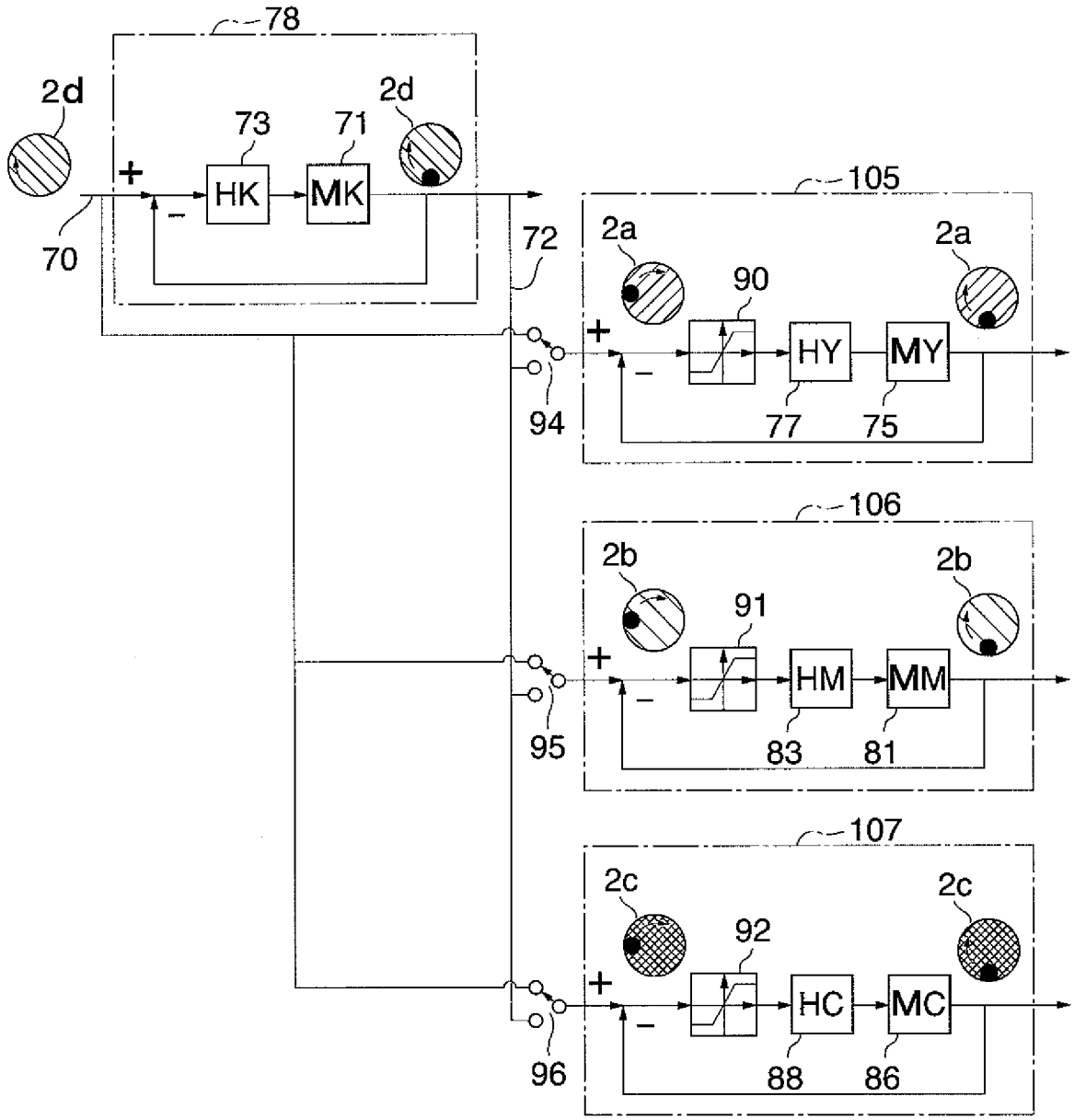
FIG. 19 is a diagram useful in explaining a variation of the image forming apparatus according to the second embodiment of the present invention.

Further, when it is desired to further reduce damage to the intermediate transfer belt 8, and the load on the drive source of the intermediate transfer belt 8, the limiters 90, 91, and 92 described above in the first embodiment may be provided, as in a variation of the present embodiment shown in FIG. 19. More specifically, in the FIG. 19 variation, the limiters 90, 91, and 92 are provided in the respective control sections 105, 106, and 107, to limit the speed differences between the photosensitive drums 2*a*, 2*b* and 2*c*, with respect to the intermediate transfer belt 8.

Figure 20A:
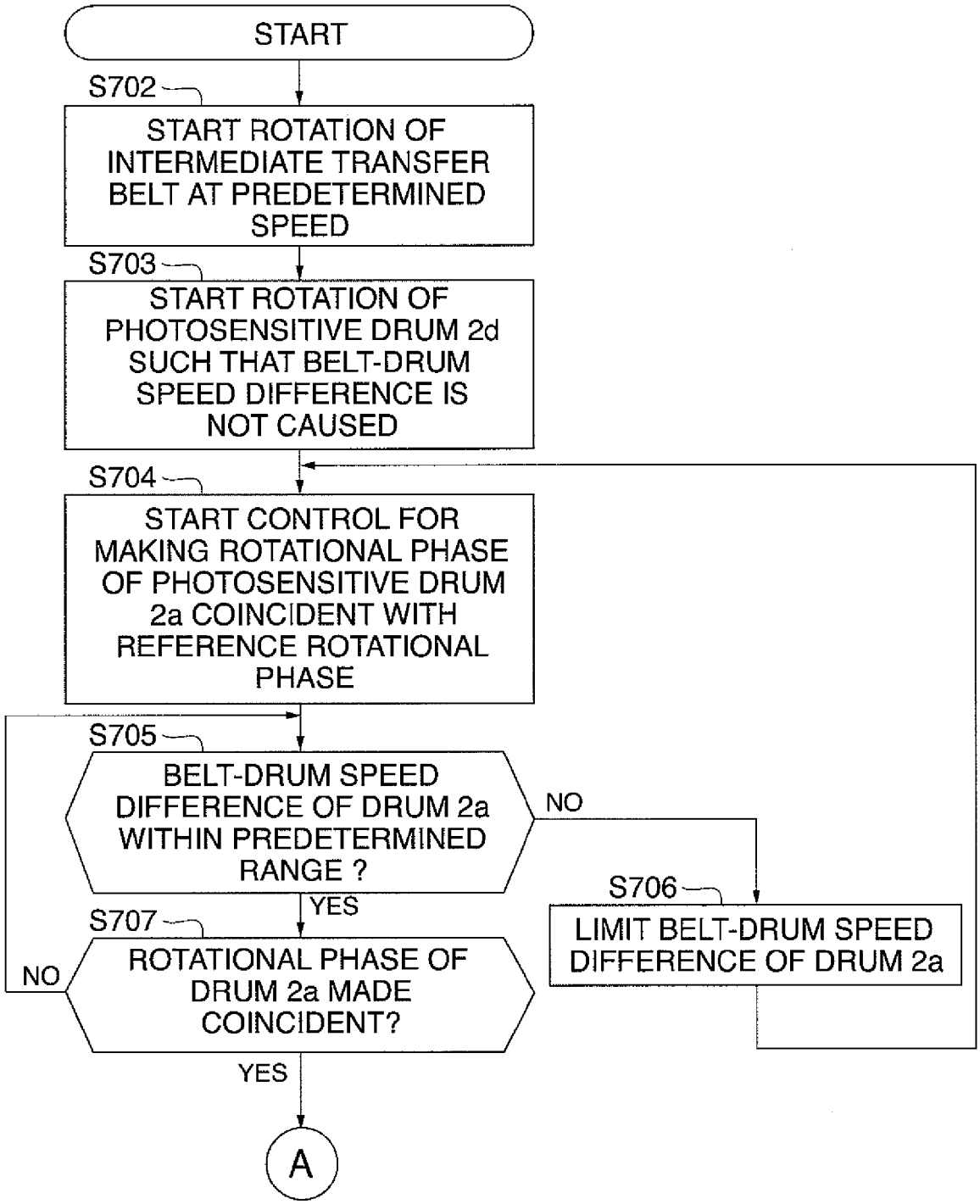
FIGS. 20A and 20B are flowcharts of a rotation control process for controlling the rotational speeds and rotational phases of the photosensitive drums by the FIG. 19 control sections.
Figure 20B:
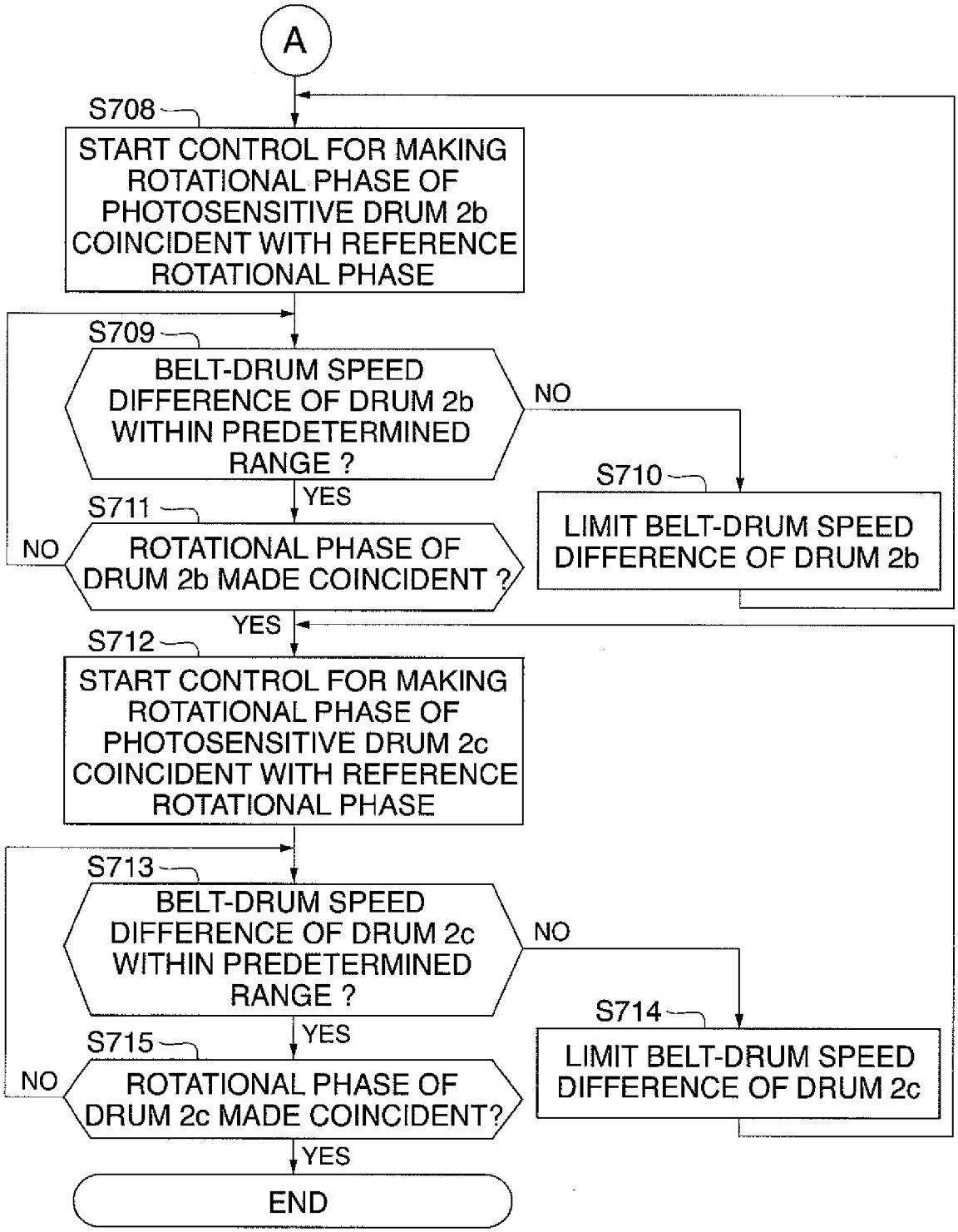

Next, a rotation control process for controlling the rotational speeds and rotational phases of the photosensitive drums 2*a*, 2*b*, 2*c*, and 2*d* by the FIG. 19 control sections of the variation of the image forming apparatus according to the present embodiment will be described with reference to FIGS. 20A and 20B.

First, in a step S702, the drive source of the intermediate transfer belt 8 is driven to rotate the intermediate transfer belt 8 at a predetermined speed, and in a step S703, the drive motor 71 of the photosensitive drum 2*d* as the reference photosensitive drum is driven to rotate the photosensitive drum 2*d*. At this time, the drive motor 71 is controlled by the controller 73 such that no speed difference is caused between the intermediate transfer belt 8 and the photosensitive drum 2*d*, i.e. that the rotational speed reference signal 70 and the rotational speed signal from the photosensitive drum 2*d* coincide with each other. It should be noted that although the steps S702 and S703 are sequentially shown, actually, the steps are simultaneously carried out. Further, the reference photosensitive drum is not limited to the photosensitive drum 2*d* but any other photosensitive drum 2*a*, 2*b*, or 2*c* may be used as the reference photosensitive drum.

In a step S704, when the speed difference between the intermediate transfer belt 8 and the photosensitive drum 2*d* has been eliminated, or before the speed difference is eliminated, the changeover switch 94 is switched to be connected to the rotational phase reference signal 72. Then, in this state, the controller 77 drives the drive motor 75 to start a rotational phase-coinciding process for making the rotational phase of the photosensitive drum 2*a* coincident with that of the photosensitive drum 2*d*.

Then, in a step S705, the limiter 90 determines whether or not the speed difference between the photosensitive drum 2*a* and the intermediate transfer belt 8 is within a predetermined range. If the speed difference is within the predetermined range, the process proceeds to a step S707, whereas if the speed difference is not within the predetermined range, the process proceeds to a step S706.

In the step S706, the limiter 90 limits the speed difference to cause the controller 77 to control the drive motor 75 such that the speed of the photosensitive drum 2*a* is limited.

On the other hand, in the step S707, it is determined whether or not the rotational phase of the photosensitive drum 2*a* has been made coincident with that of the photosensitive drum 2*d*. If the rotational phase of the photosensitive drum 2*a* has not been made coincident with that of the photosensitive drum 2*d* yet, the process returns to the step S705 so as to continue the rotational phase-coinciding process for the photosensitive drum 2*a* until the rotational phase of the photosensitive drum 2*a* has been made coincident with that of the photosensitive drum 2*d*. If the rotational phase of the photosensitive drum 2*a* has already been made coincident with that of the photosensitive drum 2*d*, the process proceeds to a step S708.

In the step S708, the changeover switch 95 is switched to be connected to the rotational phase signal 72. Then, in this state, the controller 83 drives the drive motor 81 to start a rotational phase-coinciding process for making the rotational phase of the photosensitive drum 2*b* coincident with that of the photosensitive drum 2*d*.

Next, in a step S709, the limiter 91 determines whether or not the speed difference between the photosensitive drum 2*b* and the intermediate transfer belt 8 is within the predetermined range. If the speed difference is within the predetermined range, the process proceeds to a step S711, whereas if the speed difference is not within the predetermined range, the process proceeds to a step S710.

In the step S710, the limiter 91 limits the speed difference to cause the controller 83 to control the drive motor 81 such that the speed of the photosensitive drum 2*b* is limited.

On the other hand, in the step S711, it is determined whether or not the rotational phase of the photosensitive drum 2*b* has been made coincident with that of the photosensitive drum 2*d*. If the rotational phase of the photosensitive drum 2*b* has not been made coincident with that of the photosensitive drum 2*d* yet, the process returns to the step S709 so as to continue the rotational phase-coinciding process for the photosensitive drum 2*b* until the rotational phase of the photosensitive drum 2*b* has been made coincident with that of the photosensitive drum 2*d*. If the rotational phase of the photosensitive drum 2*b* has already been made coincident with that of the photosensitive drum 2*d*, the process proceeds to a step S712.

In the step S712, the changeover switch 96 is switched to be connected to the rotational phase reference signal 72. In this state, the controller 88 drives the drive motor 86 to start an operational phase-coinciding process for making the rotational phase of the photosensitive drum 2*c* coincident with that of the photosensitive drum 2*d*.

Next, in a step S713, the limiter 92 determines whether or not the speed difference between the photosensitive drum 2*c* and the intermediate transfer belt 8 is within the predetermined range. If the speed difference is within the predetermined range, the process proceeds to a step S715, whereas if the speed difference is not within the predetermined range, the process proceeds to a step S714.

In the step S714, the limiter 92 limits the speed difference to cause the controller 86 to control the drive motor 86 such that the speed of the photosensitive drum 2*c* is limited.

On the other hand, in the step S715, it is determined whether or not the rotational phase of the photosensitive drum 2*c* has been made coincident with that of the photosensitive drum 2*d*. If the rotational phase of the photosensitive drum 2*c* has not been made coincident with that of the photosensitive drum 2*d* yet, the process returns to the step S713 so as to continue the operational phase-coinciding process for the photosensitive drum 2*c* until the rotational phase of the photosensitive drum 2*c* has been made coincident with that of the photosensitive drum 2*d*. If the rotational phase of the photosensitive drum 2*c* has already been made coincident with that of the photosensitive drum 2*d*, the present process is terminated.

Figure 21:
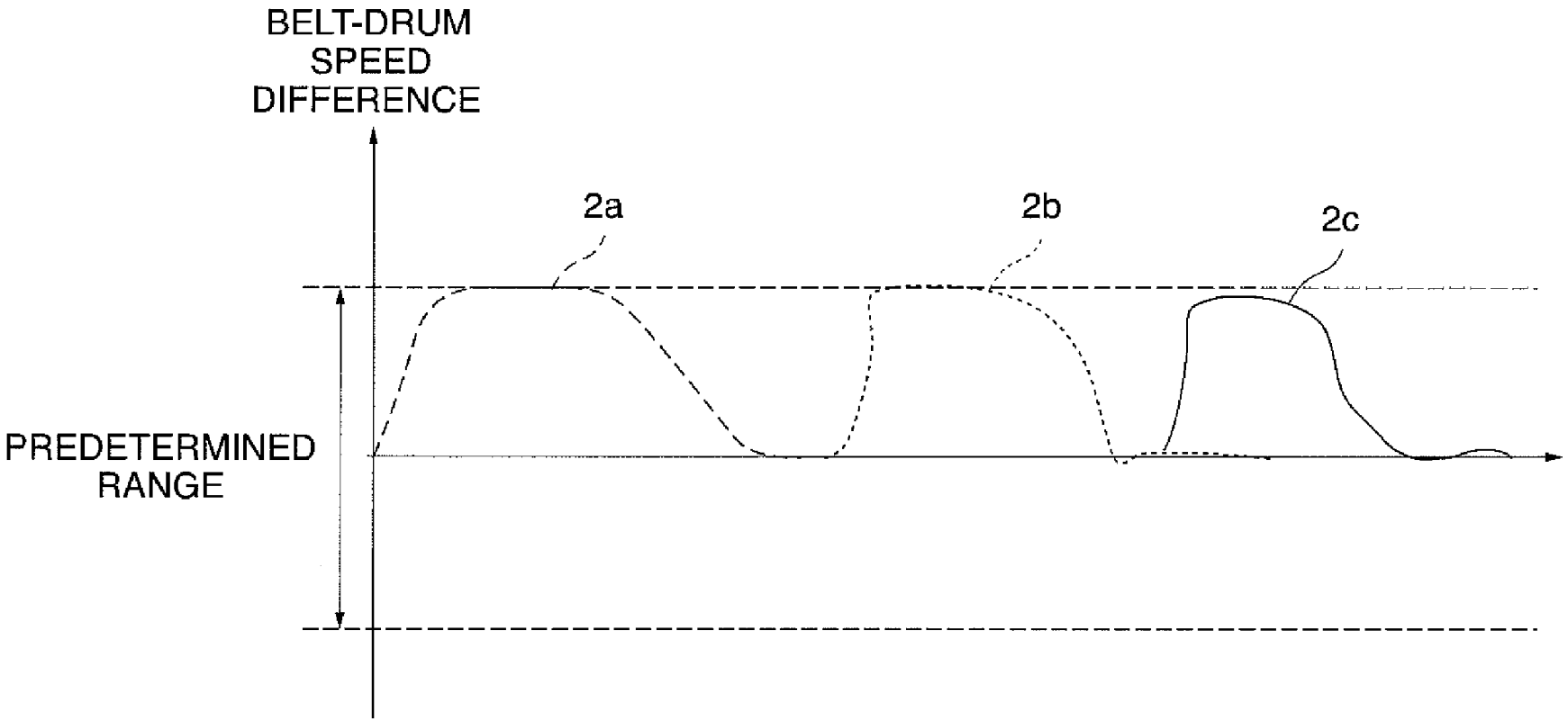
FIG. 21 is a diagram of a graph showing a state in which the timing for causing the speed difference between each photosensitive drum and the intermediate transfer belt is shifted, and at the same time the speed difference between each photosensitive drum and the intermediate transfer belt is suppressed within a certain range.

By performing the above-described control operations, as shown in FIG. 21, it is possible to shift timing in which the speed differences between the photosensitive drums 2*a*, 2*b* and 2*c*, and the intermediate transfer belt 8 are caused, thereby making it possible to suppress the speed differences within a certain range.

This makes it possible to further reduce damage to the intermediate transfer belt 8, and the load on the drive source of the intermediate transfer belt 8.

It should be noted that although in the illustrated example as well, the photosensitive drums 2*a*, 2*b*, and 2*c* are subjected to the rotational phase-coinciding process one by one in the mentioned order, the order of photosensitive drums subjected to the process is not limited to this. Further, two of the photosensitive drums 2*a*, 2*b*, and 2*c* may be simultaneously subjected to the rotational phase-coinciding process.

It should be noted that the present invention is not limited to the above-described embodiments, but it can be practiced in various forms, without departing from the spirit and scope thereof.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-201950 filed Aug. 2, 2007, which is hereby incorporated by reference herein in its entirety.

What is claimed is:

1. An image forming apparatus comprising:

a plurality of image bearing members configured to be driven for rotation;

an intermediate transfer unit configured to be driven for rotation in a state in contact with the plurality of image bearing members;

a control unit configured to cause:

(a) a first image bearing member of the plurality of image bearing members and the intermediate transfer unit to be driven for rotation in a manner eliminating a first speed difference between the first image bearing member and the intermediate transfer unit, (b) a rotational phase of a second image bearing member of the plurality of image bearing members to be coincident with the first image bearing member after initiating (a), and (c) a rotational phase of a third image bearing member of the plurality of image bearing members to be coincident with the first image bearing member after initiating (a); and a limiting unit configured to limit a second speed difference between the second image bearing member and the intermediate transfer unit, wherein the control unit is configured to cause the limiting unit to limit the second speed difference between the second image bearing member and the intermediate transfer unit after initiating (a) and during executing (b), and wherein, if the rotational phase of the second image bearing member has not been made coincident with that of the first image bearing member in (b), the control unit is configured to cause the limiting unit to repeat a determination of whether or not the second speed difference between the second image bearing member and the intermediate transfer unit is within a predetermined range.

2. An image forming apparatus as claimed in claim 1, wherein the control unit is configured to cause (b) and (c) to occur simultaneously.

3. An image forming apparatus as claimed in claim 1, wherein the control unit is configured to cause (c) to occur after the second image bearing member has been made coincident with the first image bearing member in (b).

4. An image forming apparatus as claimed in claim 1, wherein the control unit is configured to cause (b), (c), or both (b) and (c) to occur after the speed difference has been eliminated in (a).

5. An image forming apparatus as claimed in claim 1, wherein the control unit is configured to cause (b), (c), or both (b) and (c) to occur before the speed difference has been eliminated in (a).

6. An image forming apparatus as claimed in claim 1, further comprising a limiting unit configured to limit a third speed difference between the third image bearing member and the intermediate transfer unit.

7. An image forming method implemented by a control unit of an image forming apparatus, the image forming apparatus comprising a plurality of image bearing members configured to be driven for rotation and an intermediate transfer unit configured to be driven for rotation in a state in contact with the plurality of image bearing members, the method comprising the steps of:

causing (a) a first image bearing member of the plurality of image bearing members and the intermediate transfer unit to be driven for rotation in a manner eliminating a first speed difference between the first image bearing member and the intermediate transfer unit;

causing (b) a rotational phase of a second image bearing member of the plurality of image bearing members to be coincident with the first image bearing member after initiating (a);

causing (c) a rotational phase of a third image bearing member of the plurality of image bearing members to be coincident with the first image bearing member after initiating (a); and causing a limiting unit of the image forming apparatus to limit a second speed difference between the second image bearing member and the intermediate transfer unit, wherein the limiting of the second speed difference between the second image bearing member and the intermediate transfer unit is caused after initiating (a) and during executing (b), and wherein, if the rotational phase of the second image bearing member has not been made coincident with that of the first image bearing member in (b), the limiting unit is caused to repeat a determination of whether or not the second speed difference between the second image bearing member and the intermediate transfer unit is within a predetermined range.

8. An image forming method as claimed in claim 7, wherein (b) and (c) are caused to occur simultaneously.

9. An image forming method as claimed in claim 7, wherein (c) is caused to occur after the second image bearing member has been made coincident with the first image bearing member in (b).

10. An image forming method as claimed in claim 7, wherein (b), (c), or both (b) and (c) is/are caused to occur after the speed difference has been eliminated in (a).

11. An image forming method as claimed in claim 7, wherein (b), (c), or both (b) and (c) is/are caused to occur before the speed difference has been eliminated in (a).

12. An image forming method as claimed in claim 7, further comprising the step of causing a limiting unit of the image forming apparatus to limit a third speed difference between the third image bearing member and the intermediate transfer unit.

* * * * *